US012310395B1

(12) United States Patent
Ross

(10) Patent No.: US 12,310,395 B1
(45) Date of Patent: May 27, 2025

(54) ORAL FORMULATIONS OF KAVA AND NICOTINE

(71) Applicant: Jerry Wayne Ross, Santa Monica, CA (US)

(72) Inventor: Jerry Wayne Ross, Santa Monica, CA (US)

( * ) Notice: Subject to any disclaimer, the term of this patent is extended or adjusted under 35 U.S.C. 154(b) by 0 days.

(21) Appl. No.: 18/669,480

(22) Filed: May 20, 2024

(51) Int. Cl.

| | |
|---|---|
| ***A24B 15/16*** | (2020.01) |
| ***A24B 13/00*** | (2006.01) |
| ***A24B 15/30*** | (2006.01) |
| ***A24B 15/40*** | (2006.01) |
| ***A61K 36/67*** | (2006.01) |

(52) U.S. Cl.
CPC ..... *A24B 15/16* (2013.01); *A24B 13/00* (2013.01); *A24B 15/302* (2013.01); *A24B 15/403* (2013.01); *A24B 15/406* (2013.01)

(58) Field of Classification Search
None
See application file for complete search history.

(56) References Cited

U.S. PATENT DOCUMENTS

| | | | | |
|---|---|---|---|---|
| 2004/0081664 | A1* | 4/2004 | Gow | C07D 309/32 424/737 |
| 2014/0017286 | A1* | 1/2014 | Nilsson | A61K 9/1652 514/343 |
| 2015/0136160 | A1* | 5/2015 | Gordon | A61K 36/67 131/369 |
| 2021/0169125 | A1* | 6/2021 | Holton, Jr. | A24B 15/30 |

FOREIGN PATENT DOCUMENTS

WO 2019/040828 A1 2/2019

OTHER PUBLICATIONS

Berge et al., "Pharmaceutical Salts", Journal of Pharmaceutical Sciences, 1977; 66(1): pp. 1-19.

* cited by examiner

*Primary Examiner* — Dennis R Cordray
(74) *Attorney, Agent, or Firm* — Arnall Golden Gregory LLP

(57) ABSTRACT

Disclosed herein are oral formulations comprising a nicotine composition and/or a kava composition. The oral formulations comprising a nicotine composition and/or a kava composition disclosed herein may be formulated as a chewable tablet, a lozenge, a chewing gum, a dissolvable oral strip, or a pouch. Also disclosed herein are methods for making a chewable tablet, a lozenge, a chewing gum, a dissolvable oral strip, or a pouch comprising a nicotine composition and/or a kava composition.

17 Claims, No Drawings

ORAL FORMULATIONS OF KAVA AND NICOTINE

BACKGROUND

Nicotine is an alkaloid that may be derived from the leaves of *Nicotiana* spp. plants (colloquially "tobacco plants"). Nicotine has been used by adult humans for its stimulant and anxiolytic effects. Conventionally, nicotine has been delivered to users via smoking or chewing tobacco leaves, which has many well-known negative health consequences, such as exposing tissue of the oral cavity, throat, and lungs to carcinogenic substances.

In recent years, alternative nicotine delivery systems that can bypass the aforementioned negative health consequences have been developed. These alternative nicotine delivery systems, however, can suffer from disadvantages, such as an inadequate relief of nicotine cravings.

To address these shortcomings, the present inventor has developed oral nicotine formulations that contain kavalactones derived from the Pacific Island crop *Piper methysticum* (colloquially "kava"). Surprisingly, the inventor has discovered that the aforementioned problems can be overcome by delivering nicotine and kavalactones from the oral formulations disclosed herein.

SUMMARY

Embodiments of the present disclosure relate to oral formulations comprising a nicotine composition and a kava composition.

Embodiments of the present disclosure relate to an oral formulation formulated as a chewable tablet comprising a nicotine composition and a kava composition.

Embodiments of the present disclosure relate to an oral formulation formulated as a lozenge comprising a nicotine composition and a kava composition.

Embodiments of the present disclosure relate to an oral formulation formulated as a chewing gum comprising a nicotine composition and a kava composition.

Embodiments of the present disclosure relate to an oral formulation formulated as a dissolvable oral strip comprising a nicotine composition and a kava composition.

Embodiments of the present disclosure relate to an oral formulation formulated as a pouch comprising a nicotine composition and a kava composition.

Embodiments of the present disclosure relate to methods of making oral formulations comprising a nicotine composition and a kava composition.

Embodiments of the present disclosure relate to methods of making an oral formulation formulated as a chewable tablet comprising a nicotine composition and a kava composition.

Embodiments of the present disclosure relate to methods of making an oral formulation formulated as a lozenge comprising a nicotine composition and a kava composition.

Embodiments of the present disclosure relate to methods of making an oral formulation formulated as a chewing gum comprising a nicotine composition and a kava composition.

Embodiments of the present disclosure relate to methods of making an oral formulation formulated as a dissolvable oral strip comprising a nicotine composition and a kava composition.

Embodiments of the present disclosure relate to methods of making an oral formulation formulated as a pouch comprising a nicotine composition and a kava composition.

DETAILED DESCRIPTION

Some embodiments provide an oral formulation comprising an amount of a nicotine composition and/or an amount of a kava composition.

In certain embodiments, a nicotine composition, as described herein, may comprise an amount of one or more compounds selected from nicotine, nicotine acetate, nicotine benzoate, nicotine bitartrate, nicotine bitartrate dihydrate, nicotine citrate, nicotine dihydrochloride, nicotine formate, nicotine hydrochloride, nicotine lactate, nicotine laurate, nicotine levulinate, nicotine malate, nicotine polacrilex, nicotine pyruvate, nicotine salicylate, nicotine sorbate, nicotine succinate, nicotine sulphate, nicotine tartrate, nicotine zinc chloride monohydrate, and any combination thereof.

In certain embodiments, a nicotine composition, as described herein, may comprise an amount of nicotine. In some embodiments, a nicotine composition, as described herein, may comprise between about 0.1 mg and about 20 mg of nicotine, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine acetate. In some embodiments, a nicotine composition, as described herein, may comprise between about 0.1 mg and about 20 mg of nicotine acetate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine benzoate. In some embodiments, a nicotine composition, as described herein, may comprise between about 0.1 mg and about 20 mg of nicotine benzoate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine bitartrate. In some embodiments, a nicotine composition, as described herein, may comprise between about 0.1 mg and about 20 mg of nicotine bitartrate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine bitartrate dihydrate. In some embodiments, a nicotine composition, as described herein, may comprise between about 0.1 mg and about 20 mg of nicotine bitartrate dihydrate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine citrate. In some embodiments, a nicotine composition, as described herein, may comprise between about 0.1 mg and about 20 mg of nicotine citrate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine dihydrochloride. In some embodiments, a nicotine composition, as described herein, may comprise between about 0.1 mg and about 20 mg of nicotine dihydrochloride, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine formate. In some embodiments, a nicotine composition, as described herein, may comprise between about 0.1 mg and about 20 mg of nicotine formate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine hydrochloride. In some embodiments, a nicotine composition, as described herein, may comprise between about 0.1 mg and about 20 mg of nicotine hydrochloride, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine lactate. In some embodiments, a nicotine composition, as described herein, may comprise between about 0.1 mg and about 20 mg of nicotine lactate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine laurate. In some embodiments, a nicotine composition, as described herein, may comprise between about 0.1 mg and about 20 mg of nicotine laurate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine levulinate. In some embodiments, a nicotine composition, as described herein, may comprise between about 0.1 mg and about 20 mg of nicotine levulinate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine malate. In some embodiments, a nicotine composition, as described herein, may comprise between about 0.1 mg and about 20 mg of nicotine malate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine polacrilex. In some embodiments, a nicotine composition, as described herein, may comprise between about 0.1 mg and about 20 mg of nicotine polacrilex, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine pyruvate. In some embodiments, a nicotine composition, as described herein, may comprise between about 0.1 mg and about 20 mg of nicotine pyruvate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine salicylate. In some embodiments, a nicotine composition, as described herein, may comprise between about 0.1 mg and about 20 mg of nicotine salicylate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine sorbate. In some embodiments, a nicotine composition, as described herein, may comprise between about 0.1 mg and about 20 mg of nicotine sorbate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine succinate. In some embodiments, a nicotine composition, as described herein, may comprise between about 0.1 mg and about 20 mg of nicotine succinate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine sulphate. In some embodiments, a nicotine composition, as described herein, may comprise between about 0.1 mg and about 20 mg of nicotine sulphate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine tartrate. In some embodiments, a nicotine composition, as described herein, may comprise between about 0.1 mg and about 20 mg of nicotine tartrate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise an amount of nicotine zinc chloride monohydrate. In some embodiments, a nicotine composition, as described herein, may comprise between about 0.1 mg and about 20 mg of nicotine zinc chloride monohydrate, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may comprise a total nicotine content. As used herein, the term "total nicotine content," refers to a sum of the amounts of nicotine, nicotine acetate, nicotine benzoate, nicotine bitartrate, nicotine bitartrate dihydrate, nicotine citrate, nicotine dihydrochloride, nicotine formate, nicotine hydrochloride, nicotine lactate, nicotine laurate, nicotine levulinate, nicotine malate, nicotine polacrilex, nicotine pyruvate, nicotine salicylate, nicotine sorbate, nicotine succinate, nicotine sulphate, nicotine tartrate, and nicotine zinc chloride monohydrate contained in a nicotine composition, as described herein. In some embodiments, a nicotine composition, as described herein, may comprise a total nicotine content between about 0.1 mg and about 20 mg, such as, for example, 0.1 mg, 0.2 mg, 0.3 mg, 0.4 mg, 0.5 mg, 0.6 mg, 0.7 mg, 0.8 mg, 0.9 mg, 1.0 mg, 1.1 mg, 1.2 mg, 1.3 mg, 1.4 mg, 1.5 mg, 1.6 mg, 1.7 mg, 1.8 mg, 1.9 mg, 2.0 mg, 2.1 mg, 2.2 mg, 2.3 mg, 2.4 mg, 2.5 mg, 2.6 mg, 2.7 mg, 2.8 mg, 2.9 mg, 3.0 mg, 3.1 mg, 3.2 mg, 3.3 mg, 3.4 mg, 3.5 mg, 3.6 mg, 3.7 mg, 3.8 mg, 3.9 mg, 4.0 mg, 4.1 mg, 4.2 mg, 4.3 mg, 4.4 mg, 4.5 mg, 4.6 mg, 4.7 mg, 4.8 mg, 4.9 mg, 5.0 mg, 5.1 mg, 5.2 mg, 5.3 mg, 5.4 mg, 5.5 mg, 5.6 mg, 5.7 mg, 5.8 mg, 5.9 mg, 6.0 mg, 6.1 mg, 6.2 mg, 6.3 mg, 6.4 mg, 6.5 mg, 6.6 mg, 6.7 mg, 6.8 mg, 6.9 mg, 7.0 mg, 7.1 mg, 7.2 mg, 7.3 mg, 7.4 mg, 7.5 mg, 7.6 mg, 7.7 mg, 7.8 mg, 7.9 mg, 8.0 mg, 8.1 mg, 8.2 mg, 8.3 mg, 8.4 mg, 8.5 mg, 8.6 mg, 8.7 mg, 8.8 mg, 8.9 mg, 9.0 mg, 9.1 mg, 9.2 mg, 9.3 mg, 9.4 mg, 9.5 mg, 9.6 mg, 9.7 mg, 9.8 mg, 9.9 mg, 10.0 mg, 10.1 mg, 10.2 mg, 10.3 mg, 10.4 mg, 10.5 mg, 10.6 mg, 10.7 mg, 10.8 mg, 10.9 mg, 11.0 mg, 11.1 mg, 11.2 mg, 11.3 mg, 11.4 mg, 11.5 mg, 11.6 mg, 11.7 mg, 11.8 mg, 11.9 mg, 12.0 mg, 12.1 mg, 12.2 mg, 12.3 mg, 12.4 mg, 12.5 mg, 12.6 mg, 12.7 mg, 12.8 mg, 12.9 mg, 13.0 mg, 13.1 mg, 13.2 mg, 13.3 mg, 13.4 mg, 13.5 mg, 13.6 mg, 13.7 mg, 13.8 mg, 13.9 mg, 14.0 mg, 14.1 mg, 14.2 mg, 14.3 mg, 14.4 mg, 14.5 mg, 14.6 mg, 14.7 mg, 14.8 mg, 14.9 mg, 15.0 mg, 15.1 mg, 15.2 mg, 15.3 mg, 15.4 mg, 15.5 mg, 15.6 mg, 15.7 mg, 15.8 mg, 15.9 mg, 16.0 mg, 16.1 mg, 16.2 mg, 16.3 mg, 16.4 mg, 16.5 mg, 16.6 mg, 16.7 mg, 16.8 mg, 16.9 mg, 17.0 mg, 17.1 mg, 17.2 mg, 17.3 mg, 17.4 mg, 17.5 mg, 17.6 mg, 17.7 mg, 17.8 mg, 17.9 mg, 18.0 mg, 18.1 mg, 18.2 mg, 18.3 mg, 18.4 mg, 18.5 mg, 18.6 mg, 18.7 mg, 18.8 mg, 18.9 mg, 19.0 mg, 19.1 mg, 19.2 mg, 19.3 mg, 19.4 mg, 19.5 mg, 19.6 mg, 19.7 mg, 19.8 mg, 19.9 mg, 20.0 mg, or any value in between any two of the preceding amounts.

In certain embodiments, a nicotine composition, as described herein, may be substantially free of tobacco. As used herein, the term "substantially free of tobacco," refers to a nicotine composition, as described herein, that comprises less than about 0.01% wt. tobacco in the nicotine composition, i.e., mass of tobacco per mass of nicotine composition, such as, for example, less than 0.01% wt., less than 0.005% wt., less than 0.001% wt., 0% wt., or any value in between any two of the preceding amounts.

In some embodiments, a nicotine composition, as described herein, may be substantially free of tobacco-specific nitrosamines. Tobacco-specific nitrosamines, as described herein, include, but are not limited to 3-(N-nitrosomethylamino) propionitrile ("MNPN"), nitrosamino acids ("NAAs"), N-nitrosoanabasine ("NAB"), N-nitrosoanatabine ("NAT"), N-nitrosodiethanolamine ("NDELA"), N-nitrosodimethylamine ("NDMA"), N-nitrosoguvacoline ("NGL"), 3-(N-nitrosomethylamino) propionaldehyde ("NMAP"), N-nitrosomorpholine ("NMOR"), 4-(methylnitrosamino)-1-(3-pyridyl)-1-butanol ("NNAL"), 4-(N-nitrosomethylamino)-1-(3-pyridyl)-1-butanone ("NNK"), N-nitrosonornicotine ("NNN"), N-nitrosopiperidine ("NPIP"), N-nitrosopyrrolidine ("NPYR"), N-nitrososarcosine ("NSAR"), non-volatile N-nitrosamines ("nv-NAs"), volatile N-nitrosamines ("v-NAs"), and the like. As used herein, the term "substantially free of tobacco-specific nitrosamines," refers to a nicotine composition, as described herein, that comprises less than about 0.01% wt. tobacco-specific nitrosamines, as described herein, in the nicotine composition, i.e., total mass of tobacco-specific nitrosamines per mass of nicotine composition, such as, for example, less than 0.01% wt., less than 0.005% wt., less than 0.001% wt., 0% wt., or any value in between any two of the preceding amounts.

In certain embodiments, a kava composition, as described herein, may comprise an amount of one or more compounds selected from kavain, dihydrokavain, methysticin, dihydromethysticin, yangonin, desmethoxyyangonin, and any combination thereof.

In certain embodiments, a kava composition, as described herein, may comprise an amount of kavain. In some embodiments, a kava composition, as described herein, may comprise between about 1 mg and about 150 mg of kavain, such as, for example, 1 mg, 2.5 mg, 5 mg, 7.5 mg, 10 mg, 12.5 mg, 15 mg, 17.5 mg, 20 mg, 22.5 mg, 25 mg, 27.5 mg, 30 mg, 32.5 mg, 35 mg, 37.5 mg, 40 mg, 42.5 mg, 45 mg, 47.5 mg, 50 mg, 52.5 mg, 55 mg, 57.5 mg, 60 mg, 62.5 mg, 65 mg, 67.5 mg, 70 mg, 72.5 mg, 75 mg, 77.5 mg, 80 mg, 82.5 mg, 85 mg, 87.5 mg, 90 mg, 92.5 mg, 95 mg, 97.5 mg, 100 mg, 102.5 mg, 105 mg, 107.5 mg, 110 mg, 112.5 mg, 115 mg, 117.5 mg, 120 mg, 122.5 mg, 125 mg, 127.5 mg, 130 mg, 132.5 mg, 135 mg, 137.5 mg, 140 mg, 142.5 mg, 145 mg, 147.5 mg, 150 mg, or any value in between any two of the preceding amounts.

In certain embodiments, a kava composition, as described herein, may comprise an amount of dihydrokavain. In some embodiments, a kava composition, as described herein, may comprise between about 1 mg and about 150 mg of dihydrokavain, such as, for example, 1 mg, 2.5 mg, 5 mg, 7.5 mg, 10 mg, 12.5 mg, 15 mg, 17.5 mg, 20 mg, 22.5 mg, 25 mg, 27.5 mg, 30 mg, 32.5 mg, 35 mg, 37.5 mg, 40 mg, 42.5 mg, 45 mg, 47.5 mg, 50 mg, 52.5 mg, 55 mg, 57.5 mg, 60 mg, 62.5 mg, 65 mg, 67.5 mg, 70 mg, 72.5 mg, 75 mg, 77.5 mg, 80 mg, 82.5 mg, 85 mg, 87.5 mg, 90 mg, 92.5 mg, 95 mg, 97.5 mg, 100 mg, 102.5 mg, 105 mg, 107.5 mg, 110 mg, 112.5 mg, 115 mg, 117.5 mg, 120 mg, 122.5 mg, 125 mg, 127.5 mg, 130 mg, 132.5 mg, 135 mg, 137.5 mg, 140 mg, 142.5 mg, 145 mg, 147.5 mg, 150 mg, or any value in between any two of the preceding amounts.

In certain embodiments, a kava composition, as described herein, may comprise an amount of methysticin. In some embodiments, a kava composition, as described herein, may comprise between about 1 mg and about 150 mg of methysticin, such as, for example, 1 mg, 2.5 mg, 5 mg, 7.5 mg, 10 mg, 12.5 mg, 15 mg, 17.5 mg, 20 mg, 22.5 mg, 25 mg, 27.5 mg, 30 mg, 32.5 mg, 35 mg, 37.5 mg, 40 mg, 42.5 mg, 45 mg, 47.5 mg, 50 mg, 52.5 mg, 55 mg, 57.5 mg, 60 mg, 62.5 mg, 65 mg, 67.5 mg, 70 mg, 72.5 mg, 75 mg, 77.5 mg, 80 mg, 82.5 mg, 85 mg, 87.5 mg, 90 mg, 92.5 mg, 95 mg, 97.5 mg, 100 mg, 102.5 mg, 105 mg, 107.5 mg, 110 mg, 112.5 mg, 115 mg, 117.5 mg, 120 mg, 122.5 mg, 125 mg, 127.5 mg, 130 mg, 132.5 mg, 135 mg, 137.5 mg, 140 mg, 142.5 mg, 145 mg, 147.5 mg, 150 mg, or any value in between any two of the preceding amounts.

In certain embodiments, a kava composition, as described herein, may comprise an amount of dihydromethysticin. In some embodiments, a kava composition, as described herein, may comprise between about 1 mg and about 150 mg of dihydromethysticin, such as, for example, 1 mg, 2.5 mg, 5 mg, 7.5 mg, 10 mg, 12.5 mg, 15 mg, 17.5 mg, 20 mg, 22.5 mg, 25 mg, 27.5 mg, 30 mg, 32.5 mg, 35 mg, 37.5 mg, 40 mg, 42.5 mg, 45 mg, 47.5 mg, 50 mg, 52.5 mg, 55 mg, 57.5 mg, 60 mg, 62.5 mg, 65 mg, 67.5 mg, 70 mg, 72.5 mg, 75 mg, 77.5 mg, 80 mg, 82.5 mg, 85 mg, 87.5 mg, 90 mg, 92.5 mg, 95 mg, 97.5 mg, 100 mg, 102.5 mg, 105 mg, 107.5 mg, 110 mg, 112.5 mg, 115 mg, 117.5 mg, 120 mg, 122.5 mg, 125 mg, 127.5 mg, 130 mg, 132.5 mg, 135 mg, 137.5 mg, 140 mg, 142.5 mg, 145 mg, 147.5 mg, 150 mg, or any value in between any two of the preceding amounts.

In certain embodiments, a kava composition, as described herein, may comprise an amount of yangonin. In some embodiments, a kava composition, as described herein, may comprise between about 1 mg and about 150 mg of yangonin, such as, for example, 1 mg, 2.5 mg, 5 mg, 7.5 mg, 10 mg, 12.5 mg, 15 mg, 17.5 mg, 20 mg, 22.5 mg, 25 mg, 27.5 mg, 30 mg, 32.5 mg, 35 mg, 37.5 mg, 40 mg, 42.5 mg, 45 mg, 47.5 mg, 50 mg, 52.5 mg, 55 mg, 57.5 mg, 60 mg, 62.5 mg, 65 mg, 67.5 mg, 70 mg, 72.5 mg, 75 mg, 77.5 mg, 80 mg, 82.5 mg, 85 mg, 87.5 mg, 90 mg, 92.5 mg, 95 mg, 97.5 mg, 100 mg, 102.5 mg, 105 mg, 107.5 mg, 110 mg, 112.5 mg, 115 mg, 117.5 mg, 120 mg, 122.5 mg, 125 mg, 127.5 mg, 130 mg, 132.5 mg, 135 mg, 137.5 mg, 140 mg, 142.5 mg, 145 mg, 147.5 mg, 150 mg, or any value in between any two of the preceding amounts.

In certain embodiments, a kava composition, as described herein, may comprise an amount of desmethoxyyangonin. In some embodiments, a kava composition, as described herein, may comprise between about 1 mg and about 150 mg of desmethoxyyangonin, such as, for example, 1 mg, 2.5 mg, 5 mg, 7.5 mg, 10 mg, 12.5 mg, 15 mg, 17.5 mg, 20 mg, 22.5 mg, 25 mg, 27.5 mg, 30 mg, 32.5 mg, 35 mg, 37.5 mg, 40 mg, 42.5 mg, 45 mg, 47.5 mg, 50 mg, 52.5 mg, 55 mg, 57.5 mg, 60 mg, 62.5 mg, 65 mg, 67.5 mg, 70 mg, 72.5 mg, 75 mg, 77.5 mg, 80 mg, 82.5 mg, 85 mg, 87.5 mg, 90 mg, 92.5 mg, 95 mg, 97.5 mg, 100 mg, 102.5 mg, 105 mg, 107.5 mg, 110 mg, 112.5 mg, 115 mg, 117.5 mg, 120 mg, 122.5 mg, 125 mg, 127.5 mg, 130 mg, 132.5 mg, 135 mg, 137.5 mg, 140 mg, 142.5 mg, 145 mg, 147.5 mg, 150 mg, or any value in between any two of the preceding amounts.

In certain embodiments, a kava composition, as described herein, may comprise an amount of total kavalactones. As used herein, the term "amount of total kavalactones," refers to a sum of the amounts of kavain, dihydrokavain, methysticin, dihydromethysticin, yangonin, and desmethoxyyangonin contained within a kava composition, as described herein. In some embodiments, a kava composition, as described herein, may comprise between about 1 mg and about 900 mg of total kavalactones, such as, for example, 1 mg, 5 mg, 10 mg, 15 mg, 20 mg, 25 mg, 30 mg, 35 mg, 40 mg, 45 mg, 50 mg, 55 mg, 60 mg, 65 mg, 70 mg, 75 mg, 80 mg, 85 mg, 90 mg, 95 mg, 100 mg, 105 mg, 110 mg, 115 mg, 120 mg, 125 mg, 130 mg, 135 mg, 140 mg, 145 mg, 150 mg, 155 mg, 160 mg, 165 mg, 170 mg, 175 mg, 180 mg, 185 mg, 190 mg, 195 mg, 200 mg, 205 mg, 210 mg, 215 mg, 220 mg, 225 mg, 230 mg, 235 mg, 240 mg, 245 mg, 250 mg, 255 mg, 260 mg, 265 mg, 270 mg, 275 mg, 280 mg, 285 mg, 290 mg, 295 mg, 300 mg, 305 mg, 310 mg, 315 mg, 320 mg, 325 mg, 330 mg, 335 mg, 340 mg, 345 mg, 350 mg, 355 mg, 360 mg, 365 mg, 370 mg, 375 mg, 380 mg, 385 mg, 390 mg, 395 mg, 400 mg, 405 mg, 410 mg, 415 mg, 420 mg, 425 mg, 430 mg, 435 mg, 440 mg, 445 mg, 450 mg, 455 mg, 460 mg, 465 mg, 470 mg, 475 mg, 480 mg, 485 mg, 490 mg, 495 mg, 500 mg, 505 mg, 510 mg, 515 mg, 520 mg, 525 mg, 530 mg, 535 mg, 540 mg, 545 mg, 550 mg, 555 mg, 560 mg, 565 mg, 570 mg, 575 mg, 580 mg, 585 mg, 590 mg, 595 mg, 600 mg, 605 mg, 610 mg, 615 mg, 620 mg, 625 mg, 630 mg, 635 mg, 640 mg, 645 mg, 650 mg, 655 mg, 660 mg, 665 mg, 670 mg, 675 mg, 680 mg, 685 mg, 690 mg, 695 mg, 700 mg, 705 mg, 710 mg, 715 mg, 720 mg, 725 mg, 730 mg, 735 mg, 740 mg, 745 mg, 750 mg, 755 mg, 760 mg, 765 mg, 770 mg, 775 mg, 780 mg, 785 mg, 790 mg, 795 mg, 800 mg, 805 mg, 810 mg, 815 mg, 820 mg, 825 mg, 830 mg, 835 mg, 840 mg, 845 mg, 850 mg, 855 mg, 860 mg, 865 mg, 870 mg, 875 mg, 880 mg, 885 mg, 890 mg, 895 mg, 900 mg, or any value or integer in between any two of the preceding amounts.

In certain embodiments, a kava composition, as described herein, may be substantially free of flavokavain A. As used herein, the term "substantially free of flavokavain A," refers to a kava composition, as described herein, that comprises less than about 0.1% wt. flavokavain A in the kava composition, i.e., mass of flavokavain A per mass of kava composition, such as, for example, less than 0.1% wt., less than 0.05% wt., less than 0.01% wt., less than 0.005% wt, less than 0.001% wt., 0% wt., or any value in between any two of the preceding amounts.

In some embodiments, a kava composition, as described herein, may be substantially free of flavokavain B. As used herein, the term "substantially free of flavokavain B," refers to a kava composition, as described herein, that comprises less than about 0.1% wt. flavokavain B in the kava composition, i.e., mass of flavokavain B per mass of kava composition, such as, for example, less than 0.1% wt., less than 0.05% wt., less than 0.01% wt., less than 0.005% wt, less than 0.001% wt., 0% wt., or any value in between any two of the preceding amounts.

In certain embodiments, a kava composition, as described herein, may be formulated as a paste. In some embodiments, when a kava composition is formulated as a paste, as described herein, said paste may comprise at least about 68% wt. kavalactones. In certain embodiments, when a kava composition is formulated as a paste, as described herein, said paste may comprise up to about 90% wt. kavalactones. In preferable embodiments, when a paste, as described herein, comprises about 90% wt. kavalactones, and said paste is provided in an oral formulation, as described herein, the oral formulation may be palatable.

In certain embodiments, an oral formulation, as described herein, may further comprise an amount of one or more nootropics. Nootropics, as described herein, include, but are not limited to 5-hydroxytryptophan, acetyl L-carnitine, alpha-glcerylphosphorylcholine, alpha-lipoic acid, apoaequorin, ashwagandha, astaxanthin, berberine, black seed oil, cacao, caffeine, cat's claw, cannabidiol, *Celastrus paniculatus*, chaga mushroom, choline, choline bitartrate, choline citrate, citicoline, *Clitoria ternatea*, cobalamin, coconut oil, coffee grounds, cordyceps mushroom, creatine, dehydroepiandrosterone, dimethylaminoethanol, docosahexaenoic acid, fisetin, folate, forskolin, gamma aminobutyric acid, *Gingko biloba*, ginseng, glutathione, Gotu kola, ground coffee bean, guarana, holy basil, inositol, kanna, lecithin, lion's mane mushroom, L-carnosine, L-3,4-dihydroxyphenylalanine, lemon balm, L-glutamine, L-glycine, L-theanine, maca, maitake mushroom, magnesium L-threonate, luteolin, magnolia bark, medium chain triglycerides, N-acetyl-L-cysteine, N-acetyl-L-tyrosine, niacin, nicotinamide adenine dinucleotide, oat straw, oyster mushroom, passionflower, pantothenic acid, phenylalanine, phenylethylamine, phosphatidylcholine, phosphatidylserine, pine bark extract, *Polygala tenuifolia*, pyrroloquinoline quinone, pterostilbene, pyridoxine, quercetin, reishi mushroom, resveratrol, *Rhodiola rosea*, rosemary, rose root, saffron, S-adenosyl methionine, St. John's wort, sulforaphane, taurine, theobromine, thiamine, tryptophan, turmeric, tyrosine, ubiquinol, ubiquinone, uridine monophosphate, valerian root, vitamin D, water hyssop, yerba mate, and zinc. In some embodiments, an oral formulation, as described herein, may comprise between about 1 μg and about 500 mg of one or more nootropics, as described herein, such as, for example, 1 μg, 10 μg, 20 μg, 30 μg, 40 μg, 50 μg, 60 μg, 70 μg, 80 μg, 90 μg, 100 μg, 125 μg, 150 μg, 175 μg, 200 μg, 225 μg, 250 μg, 275 μg, 300 μg, 325 μg, 350 μg, 375 μg, 400 μg, 425 μg, 450 μg, 475 μg, 500 μg, 525 μg, 550 μg, 575 μg, 600 μg, 625 μg, 650 μg, 675 μg, 700 μg, 725 μg, 750 μg, 775 μg, 800 μg, 825 μg, 850 μg, 875 μg, 900 μg, 925 μg, 950 μg, 975 μg, 1 mg, 5 mg, 10 mg, 15 mg, 20 mg, 25 mg, 30 mg, 35 mg, 40 mg, 45 mg, 50 mg, 55 mg, 60 mg, 65 mg, 70 mg, 75 mg, 80 mg, 85 mg, 90 mg, 95 mg, 100 mg, 105 mg, 110 mg, 115 mg, 120 mg, 125 mg, 130 mg, 135 mg, 140 mg, 145 mg, 150 mg, 155 mg, 160 mg, 165 mg, 170 mg, 175 mg, 180 mg, 185 mg, 190 mg, 195 mg, 200 mg, 205 mg, 210 mg, 215 mg, 220 mg, 225 mg, 230 mg, 235 mg, 240 mg, 245 mg, 250 mg, 255 mg, 260 mg, 265 mg, 270 mg, 275 mg, 280 mg, 285 mg, 290 mg, 295 mg, 300 mg, 305 mg, 310 mg, 315 mg, 320 mg, 325 mg, 330 mg, 335 mg, 340 mg, 345 mg, 350 mg, 355 mg, 360 mg, 365 mg, 370 mg, 375 mg, 380 mg, 385 mg, 390 mg, 395 mg, 400 mg, 405 mg, 410 mg, 415 mg, 420 mg, 425 mg, 430 mg, 435 mg, 440 mg, 445 mg, 450 mg, 455 mg, 460 mg, 465 mg, 470 mg, 475 mg, 480 mg, 485 mg, 490 mg, 495 mg, 500 mg, or any value in between any two of the preceding amounts.

In certain embodiments, an oral formulation comprising an amount of a nicotine composition, as described herein, and an amount of a kava composition, as described herein, may release nicotine or a salt thereof slower than a commercially-available alternative. As used herein, the term "commercially-available alternative" refers to an identical oral formulation that contains an identical amount of a nicotine composition therein, as described herein, but does not contain a kava composition therein, as described herein.

In some embodiments, an oral formulation comprising an amount of a nicotine composition, as described herein, and an amount of a kava composition, as described herein, may provide a user of the oral formulation a desirable mouth numbness compared to a commercially-available alternative, as described herein.

In certain embodiments, an oral formulation comprising an amount of a nicotine composition, as described herein, and an amount of a kava composition, as described herein, may comprise a more palatable taste profile compared to a commercially-available alternative, as described herein.

In some embodiments, an oral formulation comprising an amount of a nicotine composition, as described herein, and an amount of a kava composition, as described herein, may prolong the effects of nicotine longer than a commercially-available alternative, as described herein.

In certain embodiments, an oral formulation comprising an amount of a nicotine composition, as described herein, and an amount of a kava composition, as described herein, may improve focus and/or concentration more than a commercially-available alternative, as described herein.

In some embodiments, an oral formulation comprising an amount of a nicotine composition, as described herein, and an amount of a kava composition, as described herein, may improve energy more than a commercially-available alternative, as described herein.

In certain embodiments, an oral formulation comprising an amount of a nicotine composition, as described herein, and an amount of a kava composition, as described herein, may be more durable and/or stable than a commercially-available alternative, as described herein. As used herein, the terms "durable," and "stable" refer to the physically integrity of a formulation, as described herein.

In some embodiments, an oral formulation comprising an amount of a nicotine composition, as described herein, and an amount of a kava composition, as described herein, may reduce a user's nicotine use more than a commercially-available alternative, as described herein.

In certain embodiments, an oral formulation comprising an amount of a nicotine composition, as described herein, and an amount of a kava composition, as described herein, may improve smoking cession more than a commercially-available product for smoking cessation.

In some embodiments, an oral formulation comprising an amount of a nicotine composition, as described herein, and an amount of a kava composition, as described herein, may release nicotine or a salt thereof slower than a commercially-available alternative. As used herein, the term "commercially-available alternative" refers to an identical oral formulation that contains an identical amount of a nicotine composition therein, as described herein, but does not contain a kava composition therein, as described herein.

In certain embodiments, an oral formulation comprising an amount of a nicotine composition, as described herein, and an amount of a kava composition, as described herein, may cause numbness in a user's oral cavity when used.

In some embodiments, an oral formulation comprising an amount of a nicotine composition, as described herein, and an amount of a kava composition, as described herein, may comprise a desirable taste profile.

In certain embodiments, an oral formulation comprising an amount of a nicotine composition, as described herein, and an amount of a kava composition, as described herein, may prolong the effects of nicotine.

In some embodiments, an oral formulation comprising an amount of a nicotine composition, as described herein, and an amount of a kava composition, as described herein, may improve focus and/or concentration.

In certain embodiments, an oral formulation comprising an amount of a nicotine composition, as described herein, and an amount of a kava composition, as described herein, may improve energy.

In some embodiments, an oral formulation comprising an amount of a nicotine composition, as described herein, and an amount of a kava composition, as described herein, may reduce a user's nicotine use.

In certain embodiments, an oral formulation comprising an amount of a nicotine composition, as described herein, and an amount of a kava composition, as described herein, may improve smoking cession.

Some embodiments provide an oral formulation, as described herein, formulated as a chewable tablet. In some embodiments, a chewable tablet, as described herein, may comprise an amount of a nicotine composition, as described herein, and/or an amount of a kava composition, as described herein, an amount of one or more excipients, and optionally, an amount of one or more nootropics, as described herein.

In certain embodiments, a chewable tablet, as described herein, may comprise an amount of one or more excipients including, but not limited to antioxidants, binders, disintegrants, fibers, fillers, flavorants, plasticizers, sugar alcohols, sweeteners, wetting agents, and the like.

In some embodiments, a chewable tablet, as described herein, may comprise an amount of one or more antioxidants. Antioxidants, as described herein, include, but are not limited to ascorbic acid, ascorbyl palmitate, butylated hydroxyanisole, butylated hydroxytoluene, calcium stearate, citric acid, hypophosphorous acid, monoglyceride citrate, monothioglycerol, potassium metabisulfite, propyl gallate, sodium ascorbate, sodium citrate, sodium formaldehyde sulfoxylate, sodium metabisulfite, sodium thiosulfate, sulfur dioxide, tertiary butylhydroquinone, tocopherols, and the like. In certain embodiments, a chewable tablet, as described herein, may comprise between about 0.01% wt. and about 5.0% wt. antioxidants, as described herein, in the chewable tablet, i.e., total mass of antioxidants per mass of chewable tablet, such as, for example, 0.01% wt., 0.05% wt., 0.1% wt., 0.15% wt., 0.2% wt., 0.25% wt., 0.3% wt., 0.35% wt., 0.4% wt., 0.45% wt., 0.5% wt., 0.55% wt., 0.6% wt., 0.65% wt., 0.7% wt., 0.75% wt., 0.8% wt., 0.85% wt., 0.9% wt., 0.95% wt., 1.0% wt., 1.05% wt., 1.1% wt., 1.15% wt., 1.2% wt., 1.25% wt., 1.3% wt., 1.35% wt., 1.4% wt., 1.45% wt., 1.5% wt., 1.55% wt., 1.6% wt., 1.65% wt., 1.7% wt., 1.75% wt., 1.8% wt., 1.85% wt., 1.9% wt., 1.95% wt., 2.0% wt., 2.05% wt., 2.1% wt., 2.15% wt., 2.2% wt., 2.25% wt., 2.3% wt., 2.35% wt., 2.4% wt., 2.45% wt., 2.5% wt., 2.55% wt., 2.6% wt., 2.65% wt., 2.7% wt., 2.75% wt., 2.8% wt., 2.85% wt., 2.9% wt., 2.95% wt., 3.0% wt., 3.05% wt., 3.1% wt., 3.15% wt., 3.2% wt., 3.25% wt., 3.3% wt., 3.35% wt., 3.4% wt., 3.45% wt., 3.5% wt., 3.55% wt., 3.6% wt., 3.65% wt., 3.7% wt., 3.75% wt., 3.8% wt., 3.85% wt., 3.9% wt., 3.95% wt., 4.0% wt., 4.05% wt., 4.1% wt., 4.15% wt., 4.2% wt., 4.25% wt., 4.3% wt., 4.35% wt., 4.4% wt., 4.45% wt., 4.5% wt., 4.55% wt., 4.6% wt., 4.65% wt., 4.7% wt., 4.75% wt., 4.8% wt., 4.85% wt., 4.9% wt., 4.95% wt., 5.0% wt., or any value in between any two of the preceding amounts.

In some embodiments, a chewable tablet, as described herein, may comprise an amount of one or more binders. Binders, as described herein, include, but are not limited to acacia, alginic acid, cocoa butter, dextrins, ethylcellulose, gelatins, guar gum, hydroxypropyl methylcellulose, liquid glucose, methylcellulose, microcrystalline cellulose, polyethylene oxide, polyethylene glycol, povidone, pregelatinized starches, sodium carboxymethylcellulose, starches, and the like. In certain embodiments, a chewable tablet, as described herein, may comprise between about 0.1% wt. and about 15.0% wt. binders, as described herein, in the chewable tablet, i.e., total mass of binders per mass of chewable tablet, such as, for example, 0.1% wt., 0.25% wt., 0.5% wt., 0.75% wt., 1.0% wt., 1.25% wt., 1.5% wt., 1.75% wt., 2.0% wt., 2.25% wt., 2.5% wt., 2.75% wt., 3.0% wt., 3.25% wt., 3.5% wt., 3.75% wt., 4.0% wt., 4.25% wt., 4.5% wt., 4.75% wt., 5.0% wt., 5.25% wt., 5.5% wt., 5.75% wt., 6.0% wt., 6.25% wt., 6.5% wt., 6.75% wt., 7.0% wt., 7.25% wt., 7.5% wt., 7.75% wt., 8.0% wt., 8.25% wt., 8.5% wt., 8.75% wt., 9.0% wt., 9.25% wt., 9.5% wt., 9.75% wt., 10.0% wt., 10.25% wt., 10.5% wt., 10.75% wt., 11.0% wt., 11.25% wt., 11.5% wt., 11.75% wt., 12.0% wt., 12.25% wt., 12.5% wt., 12.75% wt., 13.0% wt., 13.25% wt., 13.5% wt., 13.75% wt., 14.0% wt., 14.25% wt., 14.5% wt., 14.75% wt., 15.0% wt., or any value in between any two of the preceding amounts.

In some embodiments, a chewable tablet, as described herein, may comprise an amount of one or more disintegrants. Disintegrants, as described herein, include, but are not limited to alginic acid, croscarmellose, croscarmellose sodium, crospovidone, crosslinked croscarmellose, microcrystalline cellulose, polacrilin potassium, pregelatinized starches, sodium starch glycolate, starches, and the like. In certain embodiments, a chewable tablet, as described herein, may comprise between about 5.0% wt. and about 25.0% wt. disintegrants, as described herein, in the chewable tablet, i.e., total mass of disintegrants per mass of chewable tablet, such as, for example, 5.0% wt., 5.5% wt., 6.0% wt., 6.5% wt., 7.0% wt., 7.5% wt., 8.0% wt., 8.5% wt., 9.0% wt., 9.5% wt., 10.0% wt., 10.5% wt., 11.0% wt., 11.5% wt., 12.0% wt., 12.5% wt., 13.0% wt., 13.5% wt., 14.0% wt., 14.5% wt., 15.0% wt., 15.5% wt., 16.0% wt., 16.5% wt., 17.0% wt., 17.5% wt., 18.0% wt., 18.5% wt., 19.0% wt., 19.5% wt., 20.0% wt., 20.5% wt., 21.0% wt., 21.5% wt., 22.0% wt., 22.5% wt., 23.0% wt., 23.5% wt., 24.0% wt., 24.5% wt., 25.0% wt., or any value in between any two of the preceding amounts.

In some embodiments, a chewable tablet, as described herein, may comprise an amount of one or more fibers. Fibers, as described herein, include, but are not limited to arabinoxylans, beta-glucans, cellulose, dextrins, guar gum, gum arabic, inulins, lignins, maltodextrin, oligosaccharides, psyllium, pectins, starches, xanthan gum, digestive-resistant versions of any of the foregoing, and the like. In certain embodiments, a chewable tablet, as described herein, may comprise up to about 10.0% wt. cellulose fibers in the chewable tablet, i.e., mass of cellulose fibers per mass of chewable tablet, such as, for example, 0.1% wt., 0.5% wt., 1.0% wt., 1.5% wt., 2.0% wt., 2.5% wt., 3.0% wt., 3.5% wt., 4.0% wt., 4.5% wt., 5.0% wt., 5.5% wt., 6.0% wt., 6.5% wt., 7.0% wt., 7.5% wt., 8.0% wt., 8.5% wt., 9.0% wt., 9.5% wt., 10.0% wt., or any value in between any two of the preceding amounts. In some embodiments, a chewable tablet, as described herein, may comprise at least about 20% wt. fibers, as described herein, in the chewable tablet, i.e., total mass of fibers per mass of chewable tablet, such as, for example, at least 20.0% wt., at least 22.5% wt., at least 25.0% wt., at least 27.5% wt., at least 30.0% wt., at least 32.5% wt., at least 35.0% wt., at least 37.5% wt., at least 40.0% wt., at least 42.5% wt., at least 45.0% wt., at least 47.5% wt., at least 50.0% wt., at least 52.5% wt., at least 55.0% wt., at least 57.5% wt., at least 60.0% wt., at least 62.5% wt., at least 65.0% wt., at least 67.5% wt., at least 70.0% wt., or any value in between any two of the preceding amounts.

In some embodiments, a chewable tablet, as described herein, may comprise an amount of one or more fillers. Fillers, as described herein, include, but are not limited to acetylated monoglycerides, calcium carbonate, calcium sulfate, cellulose, citric acid, clays, corn starch, dextrates, dextrins, dextrose, dibasic calcium phosphate, fructose, glycerol monostearate, glyceryl palmitostearate, gum arabic, hydroxypropyl cellulose, hypromellose, kaolin, lactose, magnesium stearate, maltitol, maltodextrin, mannitol, microcrystalline cellulose, polysorbate 80, potassium carbonate, potassium silicate, potassium sorbate, potassium stearate, pregelatinized starches, propylene glycol monostearate, sodium alginate, sodium benzoate, sodium bicarbonate, sodium carbonate, sodium lauryl sulfate, sodium sorbitol, starches, stearyl fumarate, sucrose, talc, titanium dioxide, waxes, xanthan gum, and the like. In certain embodiments, a chewable tablet, as described herein, may comprise up to about 12.0% wt. fillers, as described herein, in the chewable tablet, i.e., total mass of fillers per mass of chewable tablet, such as, for example, 0.1% wt., 0.5% wt., 1.0% wt., 1.5% wt., 2.0% wt., 2.5% wt., 3.0% wt., 3.5% wt., 4.0% wt., 4.5% wt., 5.0% wt., 5.5% wt., 6.0% wt., 6.5% wt., 7.0% wt., 7.5% wt., 8.0% wt., 8.5% wt., 9.0% wt., 9.5% wt., 10.0% wt., 10.5% wt., 11.0% wt., 11.5% wt., 12.0% wt., or any value in between any two of the preceding amounts.

In some embodiments, a chewable tablet, as described herein, may comprise an amount of one or more flavorants. Flavorants, as described herein, include, but are not limited to apple flavoring, apricot flavoring, banana flavoring, berry flavoring, blackberry flavoring, blueberry flavoring, bubble gum flavoring, caramel flavoring, cherry flavoring, chocolate flavoring, cinnamon flavoring, citrus flavoring, coconut flavoring, coffee flavoring, cotton candy flavoring, cranberry flavoring, fruit punch flavoring, grape flavoring, grapefruit flavoring, hickory smoke flavoring, kiwi flavoring, lavender flavoring, lemon flavoring, lime flavoring, mango flavoring, maple flavoring, mint flavoring, orange flavoring, peach flavoring, peppermint flavoring, pineapple flavoring, plum flavoring, pomegranate flavoring, raspberry flavoring, spearmint flavoring, strawberry flavoring, tangerine flavoring, tobacco-imitation flavoring, vanilla flavoring, watermelon flavoring, wintergreen flavoring, and the like. In certain embodiments, a chewable tablet, as described herein, may comprise up to about 20.0% wt, flavorants, as described herein, in the chewable tablet, i.e., total mass of flavorants per mass of chewable tablet, such as, for example, 0.1% wt., 0.5% wt., 1.0% wt., 1.5% wt., 2.0% wt., 2.5% wt., 3.0% wt., 3.5% wt., 4.0% wt., 4.5% wt., 5.0% wt., 5.5% wt., 6.0% wt., 6.5% wt., 7.0% wt., 7.5% wt., 8.0% wt., 8.5% wt., 9.0% wt., 9.5% wt., 10.0% wt., 10.5% wt., 11.0% wt., 11.5% wt., 12.0% wt., 12.5% wt., 13.0% wt., 13.5% wt., 14.0% wt., 14.5% wt., 15.0% wt., 15.5% wt., 16.0% wt., 16.5% wt., 17.0% wt., 17.5% wt., 18.0% wt., 18.5% wt., 19.0% wt., 19.5% wt., 20.0% wt., or any value in between any two of the preceding amounts.

In some embodiments, a chewable tablet, as described herein, may comprise an amount of one or more plasticizers. Plasticizers, as described herein, include, but are not limited to castor oil, diacetylated monoglycerides, diethyl phthalate, glycerin, glycerol, medium chain triglycerides, liquid fats, liquid oils, liquid paraffins, mono-acetylated monoglycerides, non-liquid fats, non-liquid oils, non-liquid paraffins, partially hydrogenated oils, partially hydrogenated vegetable oils, phthalates, polycarboxylic acid esters, polyethylene glycol, propylene glycol, triacetin, triethyl citrate, triglycerides, vegetable oils, and the like. In certain embodiments, a chewable tablet, as described herein, may comprise up to about 20.0% wt. plasticizers, as described herein, in the chewable tablet, i.e., total mass of plasticizers per mass of chewable tablet, such as, for example, 0.1% wt., 0.5% wt., 1.0% wt., 1.5% wt., 2.0% wt., 2.5% wt., 3.0% wt., 3.5% wt., 4.0% wt., 4.5% wt., 5.0% wt., 5.5% wt., 6.0% wt., 6.5% wt., 7.0% wt., 7.5% wt., 8.0% wt., 8.5% wt., 9.0% wt., 9.5% wt., 10.0% wt., 10.5% wt., 11.0% wt., 11.5% wt., 12.0% wt., 12.5% wt., 13.0% wt., 13.5% wt., 14.0% wt., 14.5% wt., 15.0% wt., 15.5% wt., 16.0% wt., 16.5% wt., 17.0% wt., 17.5% wt., 18.0% wt., 18.5% wt., 19.0% wt., 19.5% wt., 20.0% wt., or any value in between any two of the preceding amounts.

In some embodiments, a chewable tablet, as described herein, may comprise an amount of one or more sugar alcohols. Sugar alcohols, as described herein, include, but are not limited to arabitol, erythritol, glycerol, hydrogenated starch hydrolysates, isomalt, lactitol, maltitol, mannitol, polyols, sorbitol, xylitol, and the like. In certain embodiments, a chewable tablet, as described herein, may comprise at least about 2.0% wt. and up to about 75.0% wt. sugar alcohols, as described herein, in the chewable tablet, i.e., total mass of sugar alcohols per mass of chewable tablet, such as, for example, at least 2.0% wt., at least 2.5% wt., at least 5% wt., at least 7.5% wt., at least 10.0% wt., at least 12.5% wt., at least 15.0% wt., at least 17.5% wt., at least 20.0% wt., at least 22.5% wt., at least 25.0% wt., at least 27.5% wt., at least 30.0% wt., at least 32.5% wt., at least 35.0% wt., at least 37.5% wt., at least 40.0% wt., at least 42.5% wt., at least 45.0% wt., at least 47.5% wt., at least 50.0% wt., at least 52.5% wt., at least 55.0% wt., at least 57.5% wt., at least 60.0% wt., at least 62.5% wt., at least 65.0% wt., at least 67.5% wt., at least 70.0% wt., at least 72.5% wt., 75.0% wt., or any value in between any two of the preceding amounts.

In some embodiments, a chewable tablet, as described herein, may comprise an amount of one or more sweeteners. Sweeteners, as described herein, include, but are not limited to acesulfame potassium, advantame, aspartame, dextrose, disaccharides, erythritol, fructose, glucose, glycerol, lactitol, lactose, maltitol, mannitol, monk fruit extract, monosaccharides, neotame, polysaccharides, saccharin, sodium saccharin, sorbitol, stevia, stevioside, sucralose, sucrose, sorbitol, xylitol, and the like. In certain embodiments, a chewable tablet, as described herein, may comprise up to about 25.0% wt. sweeteners, as described herein, in the chewable tablet, i.e., total mass of sweeteners per mass of chewable tablet, such as, for example, 0.1% wt., 0.5% wt., 1.0% wt., 1.5% wt., 2.0% wt., 2.5% wt., 3.0% wt., 3.5% wt., 4.0% wt., 4.5% wt., 5.0% wt., 5.5% wt., 6.0% wt., 6.5% wt., 7.0% wt., 7.5% wt., 8.0% wt., 8.5% wt., 9.0% wt., 9.5% wt., 10.0% wt., 10.5% wt., 11.0% wt., 11.5% wt., 12.0% wt., 12.5% wt., 13.0% wt., 13.5% wt., 14.0% wt., 14.5% wt., 15.0% wt., 15.5% wt., 16.0% wt., 16.5% wt., 17.0% wt., 17.5% wt., 18.0% wt., 18.5% wt., 19.0% wt., 19.5% wt., 20.0% wt., 20.5% wt., 21.0% wt., 21.5% wt., 22.0% wt., 22.5% wt., 23.0% wt., 23.5% wt., 24.0% wt., 24.5% wt., 25.0% wt., or any value in between any two of the preceding amounts.

In some embodiments, a chewable tablet, as described herein, may comprise an amount of one or more wetting agents. Wetting agents, as described herein, include, but are not limited to ethylene glycol, glycerin, polyethylene glycol, polypropylene glycol, propylene glycol, and the like. In certain embodiments, a chewable tablet, as described herein, may comprise between about 10.0% wt. and about 20.0% wt. wetting agents, as described herein, in the chewable tablet, i.e., total mass of wetting agents per mass of chewable tablet, such as, for example, 10.0% wt., 10.25% wt., 10.5% wt., 10.75% wt., 11.0% wt., 11.25% wt., 11.5% wt., 11.75% wt., 12.0% wt., 12.25% wt., 12.5% wt., 12.75% wt., 13.0% wt., 13.25% wt., 13.5% wt., 13.75% wt., 14.0% wt., 14.25% wt., 14.5% wt., 14.75% wt., 15.0% wt., 15.25% wt., 15.5% wt., 15.75% wt., 16.0% wt., 16.25% wt., 16.5% wt., 16.75% wt., 17.0% wt., 17.25% wt., 17.5% wt., 17.75% wt., 18.0% wt., 18.25% wt., 18.5% wt., 18.75% wt., 19.0% wt., 19.25% wt., 19.5% wt., 19.75% wt., 20.0% wt., or any value in between any two of the preceding amounts.

In some embodiments, a chewable tablet, as described herein, may further comprise a coating. In certain embodiments a coating, as described herein, may provide an oxygen barrier to the chewable tablet, provide a moisture barrier to the chewable tablet, and/or improve the mechanical properties of the chewable tablet. In some embodiments, a coating, as described herein, may comprise one or more compounds including, but not limited to acetylated monoglyceride, beeswax, bentonite, carboxymethyl cellulose, carnauba wax, cellulose acetate, cellulose acetate phthalate, erythritol, ethylcellulose, gelatins, hydrogenated starch hydrolysates, hydroxymethylcellulose, hydroxypropylated starches, methylcellulose, microcrystalline waxes, hydroxypropyl cellulose, hydroxypropyl methylcellulose, hydroxypropyl methylcellulose phthalate, isomalt, kaolin, lactitol, maltitol, mannitol, medium chain triglycerides, methacrylic acid copolymer, methylcellulose, pharmaceutical glaze, polyols, polyvinyl acetate phthalate, shellac, sodium carboxymethylcellulose, sorbitol, starches, sucrose, titanium dioxide, xylitol, waxes, zein, and the like.

In certain embodiments, a chewable tablet, as described herein, may be formulated to comprise a pH between about pH 7.0 and about pH 10.0, such as, for example, pH 7.0, pH 7.1, pH 7.2, pH 7.3, pH 7.4, pH 7.5, pH 7.6, pH 7.7, pH 7.8, pH 7.9, pH 8.0, pH 8.1, pH 8.2, pH 8.3, pH 8.4, pH 8.5, pH 8.6, pH 8.7, pH 8.8, pH 8.9, pH 9.0, pH 9.1, pH 9.2, pH 9.3, pH 9.4, pH 9.5, pH 9.6, pH 9.7, pH 9.8, pH 9.9, pH 10.0, or any value in between any two of the preceding amounts. Without being bound by any particular theory, it is believed that a chewable tablet comprising a pH between about pH 7.0 and about pH 10.0, as described herein, can have: (i) a desirable taste profile, and/or (ii) favorable absorption of a nicotine composition, as described herein, a kava composition, as described herein, and/or one or more nootropics, as described herein, without negatively impacting the oral mucosa of the user.

In some embodiments, a chewable tablet, as described herein, may be formulated to not dissolve during its duration of use. As used herein, the term "duration of use," refers to the length of time for the chewable tablet to release at least 80% of the nicotine composition contained within the chewable tablet, as described herein, and/or at least 80% of the kava composition contained within the chewable tablet, as described herein, when the chewable tablet is chewed by the user. In certain embodiments, a duration of use, as described herein, may be at least 5 minutes, such as, for example, at least 5 minutes, at least 10 minutes, at least 15 minutes, at least 20 minutes, at least 25 minutes, at least 30 minutes, at least 35 minutes, at least 40 minutes, at least 45 minutes, at least 50 minutes, at least 55 minutes, at least 60 minutes, or any value in between any two of the preceding amounts.

In some embodiments, a chewable tablet, as described herein, may comprise a dissolution time. As used herein, the term "dissolution time," refers to the length of time for the chewable tablet to fully dissolve when provided in a user's oral cavity and not chewed by the user. In some embodiments, a chewable tablet's dissolution time, as described herein, may be at least 5 minutes, such as, for example, at least 5 minutes, at least 10 minutes, at least 15 minutes, at least 20 minutes, at least 25 minutes, at least 30 minutes, at least 35 minutes, at least 40 minutes, at least 45 minutes, at least 50 minutes, at least 55 minutes, at least 60 minutes, or any value in between any two of the preceding amounts. In certain embodiments, a chewable tablet's dissolution time, as described herein, may be prolonged by coating the chewable tablet, as described herein. In some embodiments, a chewable tablet's dissolution time, as described herein, may be shortened by the user chewing the chewable tablet.

Some embodiments provide a method of making a chewable tablet, as described herein. In certain embodiments, a method of making a chewable tablet, as described herein, may comprise the steps of:

(1) preparing a first mixture by combining: (a) an amount of a nicotine composition, as described herein, (b) if used, an amount of one or more fibers, as described herein, and (c) if used, an amount of one or more fillers, as described herein, (d) if used, an amount of one or more sugar alcohols, as described herein, and (e) optionally, an amount of water;

(2) heating the first mixture under stirring to a temperature between about 60° C. and about 150° C., such as, for example, 60° C., 65° C., 70° C., 80° C., 85° C., 90° C., 95° C., 100° C., 105° C., 110° C., 115° C., 120° C., 125° C., 130° C., 125° C., 130° C., 135° C., 140° C., 145° C., 150° C., or any value in between any two of the preceding amounts;

(3) maintaining a temperature of the first mixture under stirring between about 60° C. and about 150° C., such as, for example, 60° C., 65° C., 70° C., 80° C., 85° C., 90° C., 95° C., 100° C., 105° C., 110° C., 115° C., 120° C., 125° C., 130° C., 125° C., 130° C., 135° C., 140° C., 145° C., 150° C., or any value in between any two of the preceding amounts, for at least 5 minutes, such as, for example, at least 5 minutes, at least 10 minutes, at least 15 minutes, at least 20 minutes, at least 25 minutes, at least 30 minutes, or any value in between any two of the preceding amounts;

(4) preparing a second mixture by adding to the first mixture: (a) if used, an amount of one or more antioxidants, as described herein, (b) if used, an amount of one or more binders, as described herein, (c) if used, an amount of one or more disintegrants, as described herein, (d) if used, an amount of one or more plasticizers, as described herein, and (e) if used, an amount of one or more wetting agents, as described herein;

(5) maintaining a temperature of the second mixture under stirring between about 60° C. and about 150° C., such as, for example, 60° C., 65° C., 70° C., 75° C., 80° C., 85° C., 90° C., 95° C., 100° C., 105° C., 110° C., 115° C., 120° C., 125° C., 130° C., 125° C., 130° C., 135° C., 140° C., 145° C., 150° C., or any value in between any two of the preceding amounts, for at least 30 minutes, such as, for example, at least 30 minutes, at least 35 minutes, at least 40 minutes, at least 45 minutes, at least 50 minutes, at least 55 minutes, at least 60 minutes, at least 65 minutes, at least 70 minutes, at least 75 minutes, at least 80 minutes, at least 85 minutes, at least 90 minutes, at least 95 minutes, at least 100 minutes, at least 105 minutes, at least 110 minutes, at least 155 minutes, at least 120 minutes, or any value in between any two of the preceding amounts;

(6) cooling the temperature of the second mixture to a temperature below about 60° C., such as, for example, 20° C., 25° C., 30° C., 35° C., 40° C., 45° C., 50° C., 55° C., 60° C., or any value in between any two of the preceding amounts;

(7) preparing a chewable tablet base by adding to the second mixture: (a) if used, an amount of a kava composition, as described herein, (b) if used, an amount of one or more nootropics, as described herein, (c) if used, an amount of one or more flavorants, as described herein, and (d) if used, an amount of one or more sweeteners, as described herein, and mixing until homogenous;

(8) extruding the chewable tablet base at a temperature greater than a glass transition temperature of the chewable tablet base and below about 150° C.;

(9) cutting the extruded chewable tablet base via die cutting, die stamping, laser cutting, or a similar technique to generate one or more chewable tablets, as described herein; and

(10) optionally, coating the one or more chewable tablets using conventional coating means, such as, for example, spray drying, fluidized bed coating, dip coating, and the like.

Some embodiments provide an oral formulation, as described herein, formulated as a lozenge. In some embodiments, a lozenge, as described herein, may comprise an amount of a nicotine composition, as described herein, and/or an amount of a kava composition, as described herein, an amount of one or more excipients, and optionally, an amount of one or more nootropics, as described herein.

In certain embodiments, a lozenge, as described herein, may comprise an amount of one or more excipients including, but not limited to antioxidants, fibers, fillers, film-forming polymers, flavorants, release modifiers, pH modifiers, plasticizers, solubilizing agents, sweeteners, and the like.

In some embodiments, a lozenge, as described herein, may comprise an amount of one or more antioxidants. Antioxidants, as described herein, include, but are not limited to ascorbic acid, ascorbyl palmitate, butylated hydroxyanisole, butylated hydroxytoluene, calcium stearate, citric acid, hypophosphorous acid, monoglyceride citrate, monothioglycerol, potassium metabisulfite, propyl gallate, sodium ascorbate, sodium citrate, sodium formaldehyde sulfoxylate, sodium metabisulfite, sodium thiosulfate, sulfur dioxide, tertiary butylhydroquinone, tocopherols, and the like. In certain embodiments, a lozenge, as described herein, may comprise between about 0.01% wt. and about 5.0% wt. antioxidants, as described herein, in the lozenge, i.e., total mass of antioxidants per mass of lozenge, such as, for example, 0.01% wt., 0.05% wt., 0.1% wt., 0.15% wt., 0.2% wt., 0.25% wt., 0.3% wt., 0.35% wt., 0.4% wt., 0.45% wt., 0.5% wt., 0.55% wt., 0.6% wt., 0.65% wt., 0.7% wt., 0.75% wt., 0.8% wt., 0.85% wt., 0.9% wt., 0.95% wt., 1.0% wt., 1.05% wt., 1.1% wt., 1.15% wt., 1.2% wt., 1.25% wt., 1.3% wt., 1.35% wt., 1.4% wt., 1.45% wt., 1.5% wt., 1.55% wt., 1.6% wt., 1.65% wt., 1.7% wt., 1.75% wt., 1.8% wt., 1.85% wt., 1.9% wt., 1.95% wt., 2.0% wt., 2.05% wt., 2.1% wt., 2.15% wt., 2.2% wt., 2.25% wt., 2.3% wt., 2.35% wt., 2.4% wt., 2.45% wt., 2.5% wt., 2.55% wt., 2.6% wt., 2.65% wt., 2.7% wt., 2.75% wt., 2.8% wt., 2.85% wt., 2.9% wt., 2.95% wt., 3.0% wt., 3.05% wt., 3.1% wt., 3.15% wt., 3.2% wt., 3.25% wt., 3.3% wt., 3.35% wt., 3.4% wt., 3.45% wt., 3.5% wt., 3.55% wt., 3.6% wt., 3.65% wt., 3.7% wt., 3.75% wt., 3.8% wt., 3.85% wt., 3.9% wt., 3.95% wt., 4.0% wt., 4.05% wt., 4.1% wt., 4.15% wt., 4.2% wt., 4.25% wt., 4.3% wt., 4.35% wt., 4.4% wt., 4.45% wt., 4.5% wt., 4.55% wt., 4.6% wt., 4.65% wt., 4.7% wt., 4.75% wt., 4.8% wt., 4.85% wt., 4.9% wt., 4.95% wt., 5.0% wt., or any value in between any two of the preceding amounts.

In some embodiments, a lozenge, as described herein, may comprise an amount of one or more fibers. Fibers, as described herein, include, but are not limited to arabinoxylans, beta-glucans, cellulose, dextrins, guar gum, gum arabic, inulins, lignins, maltodextrin, oligosaccharides, psyllium, pectins, starches, xanthan gum, digestive-resistant versions of any of the foregoing, and the like. In certain embodiments, a lozenge, as described herein, may comprise up to about 10.0% wt. cellulose fibers in the lozenge, i.e., mass of cellulose fibers per mass of lozenge, such as, for example, 0.1% wt., 0.5% wt., 1.0% wt., 1.5% wt., 2.0% wt., 2.5% wt., 3.0% wt., 3.5% wt., 4.0% wt., 4.5% wt., 5.0% wt., 5.5% wt., 6.0% wt., 6.5% wt., 7.0% wt., 7.5% wt., 8.0% wt., 8.5% wt., 9.0% wt., 9.5% wt., 10.0% wt., or any value in between any two of the preceding amounts. In some embodiments, a lozenge, as described herein, may comprise at least about 40.0% wt. fibers, as described herein, in the lozenge, i.e., total mass of fibers per mass of lozenge, such as, for example, at least 40.0% wt., at least 42.5% wt., at least 45.0% wt., at least 47.5% wt., at least 50.0% wt., at least 52.5% wt., at least 55.0% wt., at least 57.5% wt., at least 60.0% wt., at least 62.5% wt., at least 65.0% wt., at least 67.5% wt., at least 70.0% wt., at least 72.5% wt., at least 75.0% wt., at least 77.5% wt., at least 80.0% wt., at least 82.5% wt., at least 85.0% wt., at least 87.5% wt., at least 90.0% wt., at least 92.5% wt., at least 95.0% wt., or any value in between any two of the preceding amounts.

In some embodiments, a lozenge, as described herein, may comprise an amount of one or more fillers. Fillers, as described herein, include, but are not limited to acetylated monoglycerides, calcium carbonate, calcium sulfate, cellulose, citric acid, clays, corn starch, dextrates, dextrins, dextrose, dibasic calcium phosphate, fructose, glycerol monostearate, glyceryl palmitostearate, gum arabic, hydroxypropyl cellulose, hypromellose, kaolin, lactose, magnesium stearate, maltitol, maltodextrin, mannitol, microcrystalline cellulose, polysorbate 80, potassium carbonate, potassium silicate, potassium sorbate, potassium stearate, pregelatinized starches, propylene glycol monostearate, sodium alginate, sodium benzoate, sodium bicarbonate, sodium carbonate, sodium lauryl sulfate, sodium sorbitol, starches, stearyl fumarate, sucrose, talc, titanium dioxide, waxes, xanthan gum, and the like. In certain embodiments, a lozenge, as described herein, may comprise up to about 12.0% wt. fillers, as described herein, in the lozenge, i.e., total mass of fillers per mass of lozenge, such as, for example, 0.1% wt., 0.5% wt., 1.0% wt., 1.5% wt., 2.0% wt., 2.5% wt., 3.0% wt., 3.5% wt., 4.0% wt., 4.5% wt., 5.0% wt., 5.5% wt., 6.0% wt., 6.5% wt., 7.0% wt., 7.5% wt., 8.0% wt., 8.5% wt., 9.0% wt., 9.5% wt., 10.0% wt., or any value in between any two of the preceding amounts.

In some embodiments, a lozenge, as described herein, may comprise an amount of one or more film-forming polymers. Film-forming polymers, as described herein, include, but are not limited to amylopectins, calcium alginate, carrageenan, cellulose, collagen, gelatins, gelatin hydrolysates, hydrolyzed gelatins, hydroxypropylmethylcellulose, methylcellulose, modified starches, partially hydrolyzed collagen, partially hydrolyzed gelatins, pectins, sodium alginate, starches, starch hydrolysates, and the like. In certain embodiments, a lozenge, as described herein, may comprise between about 0.5% wt. and about 50.0% wt. film-forming polymers, as described herein, in the lozenge, i.e., total mass of film-forming polymers per mass of lozenge, such as, for example, 0.5% wt., 1.0% wt., 2.0% wt., 3.0% wt., 4.0% wt., 5.0% wt., 6.0% wt., 7.0% wt., 8.0% wt., 9.0% wt., 10.0% wt., 11.0% wt., 12.0% wt., 13.0% wt., 14.0% wt., 15.0% wt., 16.0% wt., 17.0% wt., 18.0% wt., 19.0% wt., 20.0% wt., 21.0% wt., 22.0% wt., 23.0% wt., 24.0% wt., 25.0% wt., 26.0% wt., 27.0% wt., 28.0% wt., 29.0% wt., 30.0% wt., 31.0% wt., 32.0% wt., 33.0% wt., 34.0% wt., 35.0% wt., 36.0% wt., 37.0% wt., 38.0% wt., 39.0% wt., 40.0% wt., 41.0% wt., 42.0% wt., 43.0% wt., 44.0% wt., 45.0% wt., 46.0% wt., 47.0% wt., 48.0% wt., 49.0% wt., 50.0% wt., or any value in between any two of the preceding amounts.

In some embodiments, a lozenge, as described herein, may comprise an amount of one or more flavorants. Flavorants, as described herein, include, but are not limited to apple flavoring, apricot flavoring, banana flavoring, berry flavoring, blackberry flavoring, blueberry flavoring, bubble gum flavoring, caramel flavoring, cherry flavoring, chocolate flavoring, cinnamon flavoring, citrus flavoring, coconut flavoring, coffee flavoring, cotton candy flavoring, cranberry flavoring, fruit punch flavoring, grape flavoring, grapefruit flavoring, hickory smoke flavoring, kiwi flavoring, lavender flavoring, lemon flavoring, lime flavoring, mango flavoring, maple flavoring, mint flavoring, orange flavoring, peach flavoring, peppermint flavoring, pineapple flavoring, plum flavoring, pomegranate flavoring, raspberry flavoring, spearmint flavoring, strawberry flavoring, tangerine flavoring, tobacco-imitation flavoring, vanilla flavoring, watermelon flavoring, wintergreen flavoring, and the like. In certain embodiments, a lozenge, as described herein, may comprise up to about 20.0% wt, flavorants, as described herein, in the lozenge, i.e., total mass of flavorants per mass of lozenge, such as, for example, 0.1% wt., 0.5% wt., 1.0% wt., 1.5% wt., 2.0% wt., 2.5% wt., 3.0% wt., 3.5% wt., 4.0% wt., 4.5% wt., 5.0% wt., 5.5% wt., 6.0% wt., 6.5% wt., 7.0% wt., 7.5% wt., 8.0% wt., 8.5% wt., 9.0% wt., 9.5% wt., 10.0% wt., 10.5% wt., 11.0% wt., 11.5% wt., 12.0% wt., 12.5% wt., 13.0% wt., 13.5% wt., 14.0% wt., 14.5% wt., 15.0% wt., 15.5% wt., 16.0% wt., 16.5% wt., 17.0% wt., 17.5% wt., 18.0% wt., 18.5% wt., 19.0% wt., 19.5% wt., 20.0% wt., or any value in between any two of the preceding amounts.

In some embodiments, a lozenge, as described herein, may comprise an amount of one or more release modifiers. Release modifiers, as described herein, include, but are not limited to hydroxyethyl cellulose, hydroxymethyl cellulose, hydroxypropyl cellulose, hydroxypropyl methylcellulose, methylcellulose, polyethylene oxides, polyhydroxyethylmethacrylate, polymethylmethacrylate, polyvinyl alcohol, polyvinylpyrrolidone, polyvinylpyrrolidone/vinyl acetate copolymers, and the like. In certain embodiments, a lozenge, as described herein, may comprise between about 0.5% wt. and about 20.0% wt. release modifiers, as described herein, in the lozenge, i.e., total mass of release modifiers per mass of lozenge, such as, for example, 0.5% wt., 1.0% wt., 1.5% wt., 2.0% wt., 2.5% wt., 3.0% wt., 3.5% wt., 4.0% wt., 4.5% wt., 5.0% wt., 5.5% wt., 6.0% wt., 6.5% wt., 7.0% wt., 7.5% wt., 8.0% wt., 8.5% wt., 9.0% wt., 9.5% wt., 10.0% wt., 10.5% wt., 11.0% wt., 11.5% wt., 12.0% wt., 12.5% wt., 13.0% wt., 13.5% wt., 14.0% wt., 14.5% wt., 15.0% wt., 15.5% wt., 16.0% wt., 16.5% wt., 17.0% wt., 17.5% wt., 18.0% wt., 18.5% wt., 19.0% wt., 19.5% wt., 20.0% wt., or any value in between any two of the preceding amounts.

In some embodiments, a lozenge, as described herein, may comprise an amount of one or more pH modifiers. pH modifiers, as described herein, include, but are not limited to acetic acid, aspartic acid, citric acid, fumaric acid, glutamic acid, lactic acid, malic acid, succinic acid, tartaric acid, and the like. In certain embodiments, a lozenge, as described herein, may comprise between about 0.1% wt. and about 10.0% wt. pH modifiers, as described herein, in the lozenge, i.e., total mass of pH modifiers per mass of lozenge, such as, for example, 0.1% wt., 0.25% wt., 0.5% wt., 0.75% wt., 1.0% wt., 1.25% wt., 1.5% wt., 1.75% wt., 2.0% wt., 2.25% wt., 2.5% wt., 2.75% wt., 3.0% wt., 3.25% wt., 3.5% wt., 3.75% wt., 4.0% wt., 4.25% wt., 4.5% wt., 4.75% wt., 5.0% wt., 5.25% wt., 5.5% wt., 5.75% wt., 6.0% wt., 6.25% wt., 6.5% wt., 6.75% wt., 7.0% wt., 7.25% wt., 7.5% wt., 7.75% wt., 8.0% wt., 8.25% wt., 8.5% wt., 8.75% wt., 9.0% wt., 9.25% wt., 9.5% wt., 9.75% wt., 10.0% wt., or any value in between any two of the preceding amounts.

In some embodiments, a lozenge, as described herein, may comprise an amount of one or more plasticizers. Plasticizers, as described herein, include, but are not limited to castor oil, corn syrup, diacetylated monoglycerides, diethyl phthalate, glycerin, glycerol, mannitol, medium chain triglycerides, liquid fats, liquid oils, liquid paraffins, mono-acetylated monoglycerides, non-liquid fats, non-liquid oils, non-liquid paraffins, partially dehydrated sorbitol, partially hydrogenated oils, partially hydrogenated vegetable oils, phthalates, polycarboxylic acid esters, polyethylene glycol, propylene glycol, sorbitol, triacetin, triethyl citrate, triglycerides, vegetable oils, xylitol, and the like. In certain embodiments, a lozenge, as described herein, may comprise between about 0.5% wt. and about 40.0% wt. plasticizers, as described herein, in the lozenge, i.e., total mass of plasticizers per mass of lozenge, such as, for example, 0.5% wt., 1.0% wt., 1.5% wt., 2.0% wt., 2.5% wt., 3.0% wt., 3.5% wt., 4.0% wt., 4.5% wt., 5.0% wt., 5.5% wt., 6.0% wt., 6.5% wt., 7.0% wt., 7.5% wt., 8.0% wt., 8.5% wt., 9.0% wt., 9.5% wt., 10.0% wt., 10.5% wt., 11.0% wt., 11.5% wt., 12.0% wt., 12.5% wt., 13.0% wt., 13.5% wt., 14.0% wt., 14.5% wt., 15.0% wt., 15.5% wt., 16.0% wt., 16.5% wt., 17.0% wt., 17.5% wt., 18.0% wt., 18.5% wt., 19.0% wt., 19.5% wt., 20.0% wt., 20.5% wt., 21.0% wt., 21.5% wt., 22.0% wt., 22.5% wt., 23.0% wt., 23.5% wt., 24.0% wt., 24.5% wt., 25.0% wt., 25.5% wt., 26.0% wt., 26.5% wt., 27.0% wt., 27.5% wt., 28.0% wt., 28.5% wt., 29.0% wt., 29.5% wt., 30.0% wt., 30.5% wt., 31.0% wt., 31.5% wt., 32.0% wt., 32.5% wt., 33.0% wt., 33.5% wt., 34.0% wt., 34.5% wt., 35.0% wt., 35.5% wt., 36.0% wt., 36.5% wt., 37.0% wt., 37.5% wt., 38.0% wt., 38.5% wt., 39.0% wt., 39.5% wt., 40.0% wt., or any value in between any two of the preceding amounts.

In some embodiments, a lozenge, as described herein, may comprise an amount of one or more solubilizing agents. Solubilizing agents, as described herein, include, but are not limited to acacia, cholesterol, diethanolamine, diglycerides, emulsifying waxes, glyceryl monostearate, lanolin alcohols, lecithin, monoethanolamines, monoglycerides, oleic acids, oleyl alcohols, poloxamers, polyoxyethylene stearate, polyoxyl castor oil, polyoxyl cetostearyl ether, polyoxyl hydrogenated castor oil, polyoxyl oleyl ether, polyoxyl stearate, polysorbate 20, polysorbate 40, polysorbate 60, polysorbate 80, propylene glycol diacetate, propylene glycol monostearate, sodium lauryl sulfate, sodium stearate, sorbitan monolaurate, sorbitan monooleate, sorbitan monopalmitate, sorbitan monostearate, stearic acid, trolamine, and the like. In certain embodiments, a lozenge, as described herein, may comprise between about 0.01% wt. and about 5.0% wt. solubilizing agents, as described herein, in the lozenge, i.e., total mass of solubilizing agents per mass of lozenge, such as, for example, 0.01% wt., 0.05% wt., 0.1% wt., 0.15% wt., 0.2% wt., 0.25% wt., 0.3% wt., 0.35% wt., 0.4% wt., 0.45% wt., 0.5% wt., 0.55% wt., 0.6% wt., 0.65% wt., 0.7% wt., 0.75% wt., 0.8% wt., 0.85% wt., 0.9% wt., 0.95% wt., 1.0% wt., 1.05% wt., 1.1% wt., 1.15% wt., 1.2% wt., 1.25% wt., 1.3% wt., 1.35% wt., 1.4% wt., 1.45% wt., 1.5% wt., 1.55% wt., 1.6% wt., 1.65% wt., 1.7% wt., 1.75% wt., 1.8% wt., 1.85% wt., 1.9% wt., 1.95% wt., 2.0% wt., 2.05% wt., 2.1% wt., 2.15% wt., 2.2% wt., 2.25% wt., 2.3% wt., 2.35% wt., 2.4% wt., 2.45% wt., 2.5% wt., 2.55% wt., 2.6% wt., 2.65% wt., 2.7% wt., 2.75% wt., 2.8% wt., 2.85% wt., 2.9% wt., 2.95% wt., 3.0% wt., 3.05% wt., 3.1% wt., 3.15% wt., 3.2% wt., 3.25% wt., 3.3% wt., 3.35% wt., 3.4% wt., 3.45% wt., 3.5% wt., 3.55% wt., 3.6% wt., 3.65% wt., 3.7% wt., 3.75% wt., 3.8% wt., 3.85% wt., 3.9% wt., 3.95% wt., 4.0% wt., 4.05% wt., 4.1% wt., 4.15% wt., 4.2% wt., 4.25% wt., 4.3% wt., 4.35% wt., 4.4% wt., 4.45% wt., 4.5% wt., 4.55% wt., 4.6% wt., 4.65% wt., 4.7% wt., 4.75% wt., 4.8% wt., 4.85% wt., 4.9% wt., 4.95% wt., 5.0% wt., or any value in between any two of the preceding amounts.

In some embodiments, a lozenge, as described herein, may comprise an amount of one or more sweeteners. Sweeteners, as described herein, include, but are not limited to acesulfame potassium, advantame, aspartame, dextrates, dextrose, disaccharides, erythritol, fructose, glucose, glycerol, lactitol, lactose, maltitol, mannitol, monk fruit extract, monosaccharides, neotame, polysaccharides, saccharin, sodium saccharin, sorbitol, stevia, stevioside, sucralose, sucrose, sorbitol, xylitol, and the like. In certain embodiments, a lozenge, as described herein, may comprise up to about 80.0% wt. sweeteners, as described herein, in the lozenge, i.e., total mass of sweeteners per mass of lozenge, such as, for example, 0.1% wt., 0.5% wt., 1.0% wt., 2.5% wt., 5% wt., 7.5% wt., 10.0% wt., 12.5% wt., 15.0% wt., 17.5% wt., 20.0% wt., 22.5% wt., 25.0% wt., 27.5% wt., 30.0% wt., 32.5% wt., 35.0% wt., 37.5% wt., 40.0% wt., 42.5% wt., 45.0% wt., 47.5% wt., 50.0% wt., 52.5% wt., 55.0% wt., 57.5% wt., 60.0% wt., 62.5% wt., 65.0% wt., 67.5% wt., 70.0% wt., 72.5% wt., 75.0% wt., 77.5% wt., 80.0% wt., or any value in between any two of the preceding amounts.

In some embodiments, a lozenge, as described herein, may comprise an amount of water. In certain embodiments, a lozenge, as described herein, may comprise between about 2.0% wt. and about 30% wt. water in the lozenge, i.e., mass of water per mass of lozenge, such as, for example, 2.0% wt., 2.5% wt., 3.0% wt., 3.5% wt., 4.0% wt., 4.5% wt., 5.0% wt., 5.5% wt., 6.0% wt., 6.5% wt., 7.0% wt., 7.5% wt., 8.0% wt., 8.5% wt., 9.0% wt., 9.5% wt., 10.0% wt., 10.5% wt., 11.0% wt., 11.5% wt., 12.0% wt., 12.5% wt., 13.0% wt., 13.5% wt., 14.0% wt., 14.5% wt., 15.0% wt., 15.5% wt., 16.0% wt., 16.5% wt., 17.0% wt., 17.5% wt., 18.0% wt., 18.5% wt., 19.0% wt., 19.5% wt., 20.0% wt., 20.5% wt., 21.0% wt., 21.5% wt., 22.0% wt., 22.5% wt., 23.0% wt., 23.5% wt., 24.0% wt., 24.5% wt., 25.0% wt., 25.5% wt., 26.0% wt., 26.5% wt., 27.0% wt., 27.5% wt., 28.0% wt., 28.5% wt., 29.0% wt., 29.5% wt., 30.0% wt., or any value in between any two of the preceding amounts.

In some embodiments, a lozenge, as described herein, may further comprise a coating. In certain embodiments a coating, as described herein, may provide an oxygen barrier to the lozenge, provide a moisture barrier to the lozenge, and/or improve the mechanical properties of the lozenge. In some embodiments, a coating, as described herein, may comprise one or more compounds including, but not limited to acetylated monoglyceride, beeswax, bentonite, carboxymethyl cellulose, carnauba wax, cellulose acetate, cellulose acetate phthalate, erythritol, ethylcellulose, gelatins, hydrogenated starch hydrolysates, hydroxymethylcellulose, hydroxypropylated starches, methylcellulose, microcrystalline waxes, hydroxypropyl cellulose, hydroxypropyl methylcellulose, hydroxypropyl methylcellulose phthalate, isomalt, kaolin, lactitol, maltitol, mannitol, medium chain triglycerides, methacrylic acid copolymer, methylcellulose, pharmaceutical glaze, polyols, polyvinyl acetate phthalate, shellac, sodium carboxymethylcellulose, sorbitol, starches, sucrose, titanium dioxide, xylitol, waxes, zein, and the like.

In certain embodiments, a lozenge, as described herein, may be formulated to comprise a pH between about pH 7.0 and about pH 10.0, such as, for example, pH 7.0, pH 7.1, pH 7.2, pH 7.3, pH 7.4, pH 7.5, pH 7.6, pH 7.7, pH 7.8, pH 7.9, pH 8.0, pH 8.1, pH 8.2, pH 8.3, pH 8.4, pH 8.5, pH 8.6, pH 8.7, pH 8.8, pH 8.9, pH 9.0, pH 9.1, pH 9.2, pH 9.3, pH 9.4, pH 9.5, pH 9.6, pH 9.7, pH 9.8, pH 9.9, pH 10.0, or any value in between any two of the preceding amounts. Without being bound by any particular theory, it is believed that a lozenge comprising a pH between about pH 7.0 and about pH 10.0, as described herein, can have: (i) a desirable taste profile, and/or (ii) favorable absorption of a nicotine composition, as described herein, a kava composition, as described herein, and/or one or more nootropics, as described herein, without negatively impacting the oral mucosa of the user.

In certain embodiments, a lozenge, as described herein, may comprise a dissolution time. As used herein, the term "dissolution time," refers to the length of time for the lozenge to dissolve when provided in a user's oral cavity. In some embodiments, a lozenge's dissolution time, as described herein, may be at least 2 minutes, such as, for example, at least 2 minutes, at least 5 minutes, at least 10 minutes, at least 15 minutes, at least 20 minutes, at least 25 minutes, at least 30 minutes, at least 35 minutes, at least 40 minutes, at least 45 minutes, at least 50 minutes, at least 55 minutes, at least 60 minutes, or any value in between any two of the preceding amounts. In certain embodiments, a lozenge's dissolution time, as described herein, may be prolonged by coating the lozenge, as described herein.

Some embodiments provide a method of making a lozenge, as described herein. In certain embodiments, a method of making a lozenge, as described herein, may comprise the steps of:

(1) preparing a first mixture by combining: (a) an amount of a nicotine composition, as described herein, (b) if used, an amount of one or more fibers, as described herein, and (c) if used, an amount of one or more fillers, as described herein, and (d) if used, an amount of water;

(2) heating the first mixture under stirring to a temperature between about 60° C. and about 150° C., such as, for example, 60° C., 65° C., 70° C., 80° C., 85° C., 90° C., 95° C., 100° C., 105° C., 110° C., 115° C., 120° C., 125° C., 130° C., 125° C., 130° C., 135° C., 140° C., 145° C., 150° C., or any value in between any two of the preceding amounts;

(3) maintaining a temperature of the first mixture under stirring between about 60° C. and about 150° C., such as, for example, 60° C., 65° C., 70° C., 80° C., 85° C., 90° C., 95° C., 100° C., 105° C., 110° C., 115° C., 120° C., 125° C., 130° C., 125° C., 130° C., 135° C., 140° C., 145° C., 150° C., or any value in between any two of the preceding amounts, for at least 5 minutes, such as, for example, at least 5 minutes, at least 10 minutes, at least 15 minutes, at least 20 minutes, at least 25 minutes, at least 30 minutes, or any value in between any two of the preceding amounts;

(4) preparing a second mixture by adding to the first mixture: (a) if used, an amount of one or more antioxidants, as described herein, (b) if used, an amount of one or more film-forming polymers, as described herein, (c) if used, an amount of one or more release modifiers, as described herein, (d) if used, an amount of one or more pH modifiers, as described herein, (e) if used, an amount of one or more plasticizers, as described herein, and (f) if used, an amount of one or more solubilizing agents, as described herein;

(5) maintaining a temperature of the second mixture under stirring between about 60° C. and about 150° C., such as, for example, 60° C., 65° C., 70° C., 75° C., 80° C., 85° C., 90° C., 95° C., 100° C., 105° C., 110° C., 115° C., 120° C., 125° C., 130° C., 125° C., 130° C., 135° C., 140° C., 145° C., 150° C., or any value in between any two of the preceding amounts, for at least 30 minutes, such as, for example, at least 30 minutes, at least 35 minutes, at least 40 minutes, at least 45 minutes, at least 50 minutes, at least 55 minutes, at least 60 minutes, at least 65 minutes, at least 70 minutes, at least 75 minutes, at least 80 minutes, at least 85 minutes, at least 90 minutes, at least 95 minutes, at least 100 minutes, at least 105 minutes, at least 110 minutes, at least 155 minutes, at least 120 minutes, or any value in between any two of the preceding amounts;

(6) cooling the temperature of the second mixture to a temperature below about 60° C., such as, for example, 20° C., 25° C., 30° C., 35° C., 40° C., 45° C., 50° C., 55° C., 60° C., or any value in between any two of the preceding amounts;

(7) preparing a lozenge base by adding to the second mixture: (a) if used, an amount of a kava composition, as described herein, (b) if used, an amount of one or more nootropics, as described herein, (c) if used, an amount of one or more flavorants, as described herein, and (d) if used, an amount of one or more sweeteners, as described herein, and mixing until homogenous;

(8) extruding the lozenge base at a temperature greater than a glass transition temperature of the lozenge base and below about 150° C.;

(9) cutting the extruded lozenge base via die cutting, die stamping, laser cutting, or a similar technique to generate one or more lozenges, as described herein; and

(10) optionally, coating the one or more lozenges using conventional coating means, such as, for example, spray drying, fluidized bed coating, dip coating, and the like.

Some embodiments provide an oral formulation, as described herein, formulated as a chewing gum. In some embodiments, a chewing gum, as described herein, may comprise an amount of a nicotine composition, as described herein, and/or an amount of a kava composition, as described herein, an amount of one or more excipients, and optionally, an amount of one or more nootropics, as described herein.

In certain embodiments, a chewing gum, as described herein, may comprise an amount of one or more excipients including, but not limited to antioxidants, buffers, bulk sweeteners, elastomers, fillers, flavorants, high intensity sweeteners, natural resins, plasticizers, synthetic resins, waxes, and the like.

In some embodiments, a chewing gum, as described herein, may comprise an amount of one or more antioxidants. Antioxidants, as described herein, include, but are not limited to ascorbic acid, ascorbyl palmitate, butylated hydroxyanisole, butylated hydroxytoluene, calcium stearate, citric acid, hypophosphorous acid, monoglyceride citrate, monothioglycerol, potassium metabisulfite, propyl gallate, sodium ascorbate, sodium citrate, sodium formaldehyde sulfoxylate, sodium metabisulfite, sodium thiosulfate, sulfur dioxide, tertiary butylhydroquinone, tocopherols, and the like. In certain embodiments, a chewing gum, as described herein, may comprise between about 0.01% wt. and about 5.0% wt. antioxidants, as described herein, in the chewing gum, i.e., total mass of antioxidants per mass of chewing gum, such as, for example, 0.01% wt., 0.05% wt., 0.1% wt., 0.15% wt., 0.2% wt., 0.25% wt., 0.3% wt., 0.35% wt., 0.4% wt., 0.45% wt., 0.5% wt., 0.55% wt., 0.6% wt., 0.65% wt., 0.7% wt., 0.75% wt., 0.8% wt., 0.85% wt., 0.9% wt., 0.95% wt., 1.0% wt., 1.05% wt., 1.1% wt., 1.15% wt., 1.2% wt., 1.25% wt., 1.3% wt., 1.35% wt., 1.4% wt., 1.45% wt., 1.5% wt., 1.55% wt., 1.6% wt., 1.65% wt., 1.7% wt., 1.75% wt., 1.8% wt., 1.85% wt., 1.9% wt., 1.95% wt., 2.0% wt., 2.05% wt., 2.1% wt., 2.15% wt., 2.2% wt., 2.25% wt., 2.3% wt., 2.35% wt., 2.4% wt., 2.45% wt., 2.5% wt., 2.55% wt., 2.6% wt., 2.65% wt., 2.7% wt., 2.75% wt., 2.8% wt., 2.85% wt., 2.9% wt., 2.95% wt., 3.0% wt., 3.05% wt., 3.1% wt., 3.15% wt., 3.2% wt., 3.25% wt., 3.3% wt., 3.35% wt., 3.4% wt., 3.45% wt., 3.5% wt., 3.55% wt., 3.6% wt., 3.65% wt., 3.7% wt., 3.75% wt., 3.8% wt., 3.85% wt., 3.9% wt., 3.95% wt., 4.0% wt., 4.05% wt., 4.1% wt., 4.15% wt., 4.2% wt., 4.25% wt., 4.3% wt., 4.35% wt., 4.4% wt., 4.45% wt., 4.5% wt., 4.55% wt., 4.6% wt., 4.65% wt., 4.7% wt., 4.75% wt., 4.8% wt., 4.85% wt., 4.9% wt., 4.95% wt., 5.0% wt., or any value in between any two of the preceding amounts.

In some embodiments, a chewing gum, as described herein, may comprise an amount of one or more buffers. Buffers, as described herein, include, but are not limited to acetic acid, adipic acid, alkali-/alkaline-metal acetates, alkali-/alkaline-metal bicarbonates, alkali-/alkaline-metal citrates, alkali-/alkaline-metal diphosphates, alkali-/alkaline-metal glycerinates, alkali-/alkaline-metal glyconates, alkali-/alkaline-metal glycerophosphates, alkali-/alkaline-metal monocarbonates, alkali-/alkaline-metal orthophosphates, alkali-/alkaline-metal phosphates, alkali-/alkaline-metal polyphosphates, alkali-/alkaline-metal sesquicarbonates, alkali-/alkaline-metal triphosphates, amino acid buffers, ammonium buffers, ascorbic acid, carbonic acid, citric acid, fumaric acid, glucono-8-lactone, gluconic acid, lactic acid, magnesium oxide, malic acid, maleic acid, phosphoric acid, propionic acid, succinic acid, tartaric acid, tris buffers, and the like. In certain embodiments, a chewing gum, as described herein, may comprise between about 0.5% wt. and about 10.0% wt. buffers, as described herein, in the chewing gum, i.e., total mass of buffers per mass of chewing gum, such as, for example, 0.5% wt., 0.75% wt., 1.0% wt., 1.25% wt., 1.5% wt., 1.75% wt., 2.0% wt., 2.25% wt., 2.5% wt., 2.75% wt., 3.0% wt., 3.25% wt., 3.5% wt., 3.75% wt., 4.0% wt., 4.25% wt., 4.5% wt., 4.75% wt., 5.0% wt., 5.25% wt., 5.5% wt., 5.75% wt., 6.0% wt., 6.25% wt., 6.5% wt., 6.75% wt., 7.0% wt., 7.25% wt., 7.5% wt., 7.75% wt., 8.0% wt., 8.25% wt., 8.5% wt., 8.75% wt., 9.0% wt., 9.25% wt., 9.5% wt., 9.75% wt., 10.0% wt., or any value in between any two of the preceding amounts.

In some embodiments, a chewing gum, as described herein, may comprise an amount of one or more bulk sweeteners. Bulk sweeteners, as described herein, include, but are not limited to corn syrup solids, dextrins, dextrose, disaccharides, D-tagatose, erythritol, fructose, galactose, hydrogenated starch hydrolysates, isomalt, lactitol, levulose, maltitol, maltose, mannitol, monosaccharides, polyols, polysaccharides, sorbitol, sucrose, trehalose, xylitol, and the like. In certain embodiments, a chewing gum, as described herein, may comprise up to about 95.0% wt. bulk sweeteners, as described herein, in the chewing gum, i.e., total mass of bulk sweeteners per mass of chewing gum, such as, for example, 0.5% wt., 1.0% wt., 2.5% wt., 5.0% wt., 7.5% wt., 10.0% wt., 12.5% wt., 15.0% wt., 17.5% wt., 20.0% wt., 22.5% wt., 25.0% wt., 27.5% wt., 30.0% wt., 32.5% wt., 35.0% wt., 37.5% wt., 40.0% wt., 42.5% wt., 45.0% wt., 47.5% wt., 50.0% wt., 52.5% wt., 55.0% wt., 57.5% wt., 60.0% wt., 62.5% wt., 65.0% wt., 67.5% wt., 70.0% wt., 72.5% wt., 75.0% wt., 77.5% wt., 80.0% wt., 82.5% wt., 85.0% wt., 87.5% wt., 90.0% wt., 92.5% wt., 95.0% wt., or any value in between any two of the preceding amounts.

In some embodiments, a chewing gum, as described herein, may comprise an amount of one or more elastomers. Elastomers, as described herein, include, but are not limited to balata, butadiene-styrene copolymers, chicle gum, crown gum, gutta kay, gutta percha, guayale, isobutylene-isoprene copolymers, jelutong, latexes, lechi capsi, natural rubbers, niger gutta, nispero, perillo, polyethylene, polyisobutylene, polyvinyl acetates, rosidinha, sorva, styrene-butadiene copolymers, tunu, and the like. In certain embodiments, a chewing gum, as described herein, may comprise between about 5.0% wt. and about 80.0% wt. elastomers, as described herein, in the chewing gum, i.e., total mass of elastomers per mass of chewing gum, such as, for example, 5.0% wt., 7.5% wt., 10.0% wt., 12.5% wt., 15.0% wt., 17.5% wt., 20.0% wt., 22.5% wt., 25.0% wt., 27.5% wt., 30.0% wt., 32.5% wt., 35.0% wt., 37.5% wt., 40.0% wt., 42.5% wt., 45.0% wt., 47.5% wt., 50.0% wt., 52.5% wt., 55.0% wt., 57.5% wt., 60.0% wt., 62.5% wt., 65.0% wt., 67.5% wt., 70.0% wt., 72.5% wt., 75.0% wt., 77.5% wt., 80.0% wt., or any value in between any two of the preceding amounts.

In some embodiments, a chewing gum, as described herein, may comprise an amount of one or more fillers. Fillers, as described herein, include, but are not limited to alumina, aluminum hydroxide, aluminum oxide, aluminum silicates, calcium carbonate, calcium diphosphate, calcium monophosphate, calcium triphosphate, cellulose, clays, dicalcium phosphate, ground limestone, kaolin, magnesium carbonate, magnesium silicates, sodium sulphate, talc, titanium oxide, and the like. In certain embodiments, a chewing gum, as described herein, may comprise up to about 50.0% wt. fillers, as described herein, in the chewing gum, i.e., total mass of fillers per mass of chewing gum, such as, for example, 0.1% wt., 0.5% wt., 1% wt., 2.5% wt., 5.0% wt., 7.5% wt., 10.0% wt., 12.5% wt., 15.0% wt., 17.5% wt., 20.0% wt., 22.5% wt., 25.0% wt., 27.5% wt., 30.0% wt., 32.5% wt., 35.0% wt., 37.5% wt., 40.0% wt., 42.5% wt., 45.0% wt., 47.5% wt., 50.0% wt., or any value in between any two of the preceding amounts.

In some embodiments, a chewing gum, as described herein, may comprise an amount of one or more flavorants. Flavorants, as described herein, include, but are not limited to apple flavoring, apricot flavoring, banana flavoring, berry flavoring, blackberry flavoring, blueberry flavoring, bubble gum flavoring, caramel flavoring, cherry flavoring, chocolate flavoring, cinnamon flavoring, citrus flavoring, coconut flavoring, coffee flavoring, cotton candy flavoring, cranberry flavoring, fruit punch flavoring, grape flavoring, grapefruit flavoring, hickory smoke flavoring, kiwi flavoring, lavender flavoring, lemon flavoring, lime flavoring, mango flavoring, maple flavoring, mint flavoring, orange flavoring, peach flavoring, peppermint flavoring, pineapple flavoring, plum flavoring, pomegranate flavoring, raspberry flavoring, spearmint flavoring, strawberry flavoring, tangerine flavoring, tobacco-imitation flavoring, vanilla flavoring, watermelon flavoring, wintergreen flavoring, and the like. In certain embodiments, a chewable tablet, as described herein, may comprise up to about 3.5% wt, flavorants, as described herein, in the chewing gum, i.e., total mass of flavorants per mass of chewing gum, such as, for example, 0.01% wt., 0.05% wt., 0.1% wt., 0.15% wt., 0.2% wt., 0.25% wt., 0.3% wt., 0.35% wt., 0.4% wt., 0.45% wt., 0.5% wt., 0.55% wt., 0.6% wt., 0.65% wt., 0.7% wt., 0.75% wt., 0.8% wt., 0.85% wt., 0.9% wt., 0.95% wt., 1.0% wt., 1.05% wt., 1.1% wt., 1.15% wt., 1.2% wt., 1.25% wt., 1.3% wt., 1.35% wt., 1.4% wt., 1.45% wt., 1.5% wt., 1.55% wt., 1.6% wt., 1.65% wt., 1.7% wt., 1.75% wt., 1.8% wt., 1.85% wt., 1.9% wt., 1.95% wt., 2.0% wt., 2.05% wt., 2.1% wt., 2.15% wt., 2.2% wt., 2.25% wt., 2.3% wt., 2.35% wt., 2.4% wt., 2.45% wt., 2.5% wt., 2.55% wt., 2.6% wt., 2.65% wt., 2.7% wt., 2.75% wt., 2.8% wt., 2.85% wt., 2.9% wt., 2.95% wt., 3.0% wt., 3.05% wt., 3.1% wt., 3.15% wt., 3.2% wt., 3.25% wt., 3.3% wt., 3.35% wt., 3.4% wt., 3.45% wt., 3.5% wt., 3.55% wt., 3.6% wt., 3.65% wt., 3.7% wt., 3.75% wt., 3.8% wt., 3.85% wt., 3.9% wt., 3.95% wt., 4.0% wt., 4.05% wt., 4.1% wt., 4.15% wt., 4.2% wt., 4.25% wt., 4.3% wt., 4.35% wt., 4.4% wt., 4.45% wt., 4.5% wt., 4.55% wt., 4.6% wt., 4.65% wt., 4.7% wt., 4.75% wt., 4.8% wt., 4.85% wt., 4.9% wt., 4.95% wt., 5.0% wt., or any value in between any two of the preceding amounts.

In some embodiments, a chewing gum, as described herein, may comprise an amount of one or more high intensity sweeteners. High intensity sweeteners, as described herein, include, but are not limited to acesulfame potassium, advantame, alitame, aspartame, dihydrochalcones, glycyrrhizin, monk fruit extract, neotame, saccharin, sodium saccharin, stevia, stevioside, sucralose, thaumatin, and the like. In certain embodiments, a chewing gum, as described herein, may comprise up to about 8.0% wt. high intensity sweeteners, as described herein, in the chewing gum, i.e., total mass of high intensity sweeteners per mass of chewing gum, such as, for example, 0.1% wt., 0.25% wt., 0.5% wt., 0.75% wt., 1.0% wt., 1.25% wt., 1.5% wt., 1.75% wt., 2.0% wt., 2.25% wt., 2.5% wt., 2.75% wt., 3.0% wt., 3.25% wt., 3.5% wt., 3.75% wt., 4.0% wt., 4.25% wt., 4.5% wt., 4.75% wt., 5.0% wt., 5.25% wt., 5.5% wt., 5.75% wt., 6.0% wt., 6.25% wt., 6.5% wt., 6.75% wt., 7.0% wt., 7.25% wt., 7.5% wt., 7.75% wt., 8.0% wt., or any value in between any two of the preceding amounts.

In some embodiments, a chewing gum, as described herein, may comprise an amount of one or more natural resins. Natural resins, as described herein, include, but are not limited to glycerol esters of partially dimerized rosins, glycerol esters of partially hydrogenated rosins, glycerol esters of polymerized rosins, glycerol esters of tally oil rosins, methyl esters of rosins, natural rosin esters, partially hydrogenated methyl esters of rosins, pentaerythritol esters of partially hydrogenated rosins, pentaerythritol esters of rosins, and the like. In certain embodiments, a chewing gum, as described herein, may comprise between about 0.1% wt. and about 75.0% wt. natural resins, as described herein, in the chewing gum, i.e., total mass of natural resins per mass of chewing gum, such as, for example, 0.1% wt., 0.5% wt., 1% wt., 2.5% wt., 5.0% wt., 7.5% wt., 10.0% wt., 12.5% wt., 15.0% wt., 17.5% wt., 20.0% wt., 22.5% wt., 25.0% wt., 27.5% wt., 30.0% wt., 32.5% wt., 35.0% wt., 37.5% wt., 40.0% wt., 42.5% wt., 45.0% wt., 47.5% wt., 50.0% wt., 52.5% wt., 55.0% wt., 57.5% wt., 60.0% wt., 62.5% wt., 65.0% wt., 67.5% wt., 70.0% wt., 72.5% wt., 75.0% wt., or any value in between any two of the preceding amounts.

In some embodiments, a chewing gum, as described herein, may comprise an amount of one or more plasticizers. Plasticizers, as described herein, include, but are not limited to cocoa butter, cottonseed oil, fats, glycerin, glycerol monostearate, glycerol triacetate, hydrogenated vegetable oils, lanolin, lard, lecithin, microcrystalline waxes, natural waxes, oils, partially hydrogenated vegetable oils, petroleum waxes, polyvinyl acetates, stearic acid, soybean oil, tallow, triacetin, vegetable oils, and the like. In certain embodiments, a chewing gum, as described herein, may comprise up to about 40.0% wt. plasticizers, as described herein, in the chewing gum, i.e., total mass of plasticizers per mass of chewing gum, such as, for example, 0.1% wt., 0.5% wt., 1% wt., 2.5% wt., 5.0% wt., 7.5% wt., 10.0% wt., 12.5% wt., 15.0% wt., 17.5% wt., 20.0% wt., 22.5% wt., 25.0% wt., 27.5% wt., 30.0% wt., 32.5% wt., 35.0% wt., 37.5% wt., 40.0% wt., or any value in between any two of the preceding amounts.

In some embodiments, a chewing gum, as described herein, may comprise an amount of one or more synthetic resins. Synthetic resins, as described herein, include, but are not limited to natural terpene resins, terpene resins derived from alpha-pinene, terpene resins derived from beta-pinene, terpene resins derived from d-limonene, and the like. In certain embodiments, a chewing gum, as described herein, may comprise between about 0.1% wt. and about 40.0% wt. synthetic resins, as described herein, in the chewing gum, i.e., total mass of synthetic resins per mass of chewing gum, such as, for example, 0.1% wt., 0.5% wt., 1% wt., 2.5% wt., 5.0% wt., 7.5% wt., 10.0% wt., 12.5% wt., 15.0% wt., 17.5% wt., 20.0% wt., 22.5% wt., 25.0% wt., 27.5% wt., 30.0% wt., 32.5% wt., 35.0% wt., 37.5% wt., 40.0% wt., or any value in between any two of the preceding amounts.

In some embodiments, a chewing gum, as described herein, may comprise an amount of one or more waxes. Waxes, as described herein, include, but are not limited to beeswax, carnauba wax, microcrystalline waxes, paraffin waxes, petroleum waxes, refined paraffins, and the like. In certain embodiments, a chewing gum, as described herein, may comprise up to about 40.0% wt. waxes, as described herein, in the chewing gum, i.e., total mass of waxes per mass of chewing gum, such as, for example, 0.1% wt., 0.5% wt., 1% wt., 2.5% wt., 5.0% wt., 7.5% wt., 10.0% wt., 12.5% wt., 15.0% wt., 17.5% wt., 20.0% wt., 22.5% wt., 25.0% wt., 27.5% wt., 30.0% wt., 32.5% wt., 35.0% wt., 37.5% wt., 40.0% wt., or any value in between any two of the preceding amounts.

In some embodiments, a chewing gum, as described herein, may further comprise a coating. In certain embodiments a coating, as described herein, may provide an oxygen barrier to the chewing gum, provide a moisture barrier to the chewing gum, and/or improve the mechanical properties of the chewing gum. In some embodiments, a coating, as described herein, may comprise one or more compounds including, but not limited to acetylated monoglyceride, beeswax, bentonite, carboxymethyl cellulose, carnauba wax, cellulose acetate, cellulose acetate phthalate, erythritol, ethylcellulose, gelatin, hydrogenated starch hydrolysates, hydroxymethylcellulose, hydroxypropylated starches, methylcellulose, microcrystalline waxes, hydroxypropyl cellulose, hydroxypropyl methylcellulose, hydroxypropyl methylcellulose phthalate, isomalt, kaolin, lactitol, maltitol, mannitol, medium chain triglycerides, methacrylic acid copolymer, methylcellulose, pharmaceutical glaze, polyols, polyvinyl acetate phthalate, shellac, sodium carboxymethylcellulose, sorbitol, starches, sucrose, titanium dioxide, xylitol, waxes, zein, and the like.

In certain embodiments, a chewing gum, as described herein, may be formulated to comprise a pH between about pH 7.0 and about pH 10.0, such as, for example, pH 7.0, pH 7.1, pH 7.2, pH 7.3, pH 7.4, pH 7.5, pH 7.6, pH 7.7, pH 7.8, pH 7.9, pH 8.0, pH 8.1, pH 8.2, pH 8.3, pH 8.4, pH 8.5, pH 8.6, pH 8.7, pH 8.8, pH 8.9, pH 9.0, pH 9.1, pH 9.2, pH 9.3, pH 9.4, pH 9.5, pH 9.6, pH 9.7, pH 9.8, pH 9.9, pH 10.0, or any value in between any two of the preceding amounts. Without being bound by any particular theory, it is believed that a chewing gum comprising a pH between about pH 7.0 and about pH 10.0, as described herein, can have: (i) a desirable taste profile, and/or (ii) favorable absorption of a nicotine composition, as described herein, a kava composition, as described herein, and/or one or more nootropics, as described herein, without negatively impacting the oral mucosa of the user.

In some embodiments, a chewing gum, as described herein, may be formulated to not dissolve during its duration of use. As used herein, the term "duration of use," refers to the length of time for the chewing gum to release at least 80% of the nicotine composition contained within the chewing gum, as described herein, and/or at least 80% of the kava composition contained within the chewing gum, as described herein, when the chewing gum is chewed by the user. In certain embodiments, a duration of use, as described herein, may be at least 5 minutes, such as, for example, at least 5 minutes, at least 10 minutes, at least 15 minutes, at least 20 minutes, at least 25 minutes, at least 30 minutes, at least 35 minutes, at least 40 minutes, at least 45 minutes, at least 50 minutes, at least 55 minutes, at least 60 minutes, or any value in between any two of the preceding amounts.

Some embodiments provide a method of making a chewing gum, as described herein. In certain embodiments, a method of making a chewing gum, as described herein, may comprise the steps of:

(1) preparing a first mixture by combining: (a) an amount of one or more elastomers, as described herein, (b) if used, an amount of one or more fillers, as described herein, (c) if used, an amount of one or more synthetic resins, as described herein, and (d) optionally, an amount of water;

(2) melting the first mixture under stirring by heating the first mixture to a temperature between about 60° C. and about 140° C., such as, for example, 60° C., 65° C., 70° C., 80° C., 85° C., 90° C., 95° C., 100° C., 105° C., 110° C., 115° C., 120° C., 125° C., 130° C., 125° C., 130° C., 135° C., 140° C., or any value in between any two of the preceding amounts;

(3) maintaining a temperature of the first mixture under stirring between about 60° C. and about 140° C., such as, for example, 60° C., 65° C., 70° C., 80° C., 85° C., 90° C., 95° C., 100° C., 105° C., 110° C., 115° C., 120° C., 125° C., 130° C., 125° C., 130° C., 135° C., 140° C., or any value in between any two of the preceding amounts, for at least 5 minutes, such as, for example, at least 5 minutes, at least 10 minutes, at least 15 minutes, at least 20 minutes, at least 25 minutes, at least 30 minutes, or any value in between any two of the preceding amounts;

(4) preparing a second mixture by adding to the first mixture: (a) an amount of a nicotine composition, as described herein, (b) if used, an amount of one or more antioxidants, as described herein, (c) if used, an amount of one or more natural resins, as described herein, (d) if used, an amount of one or more plasticizers, as described herein, and (e) if used, an amount of one or more waxes, as described herein;

(5) maintaining a temperature of the second mixture under stirring between about 60° C. and about 140° C., such as, for example, 60° C., 65° C., 70° C., 75° C., 80° C., 85° C., 90° C., 95° C., 100° C., 105° C., 110° C., 115° C., 120° C., 125° C., 130° C., 125° C., 130° C., 135° C., 140° C., or any value in between any two of the preceding amounts, for at least 30 minutes, such as, for example, at least 30 minutes, at least 35 minutes, at least 40 minutes, at least 45 minutes, at least 50 minutes, at least 55 minutes, at least 60 minutes, at least 65 minutes, at least 70 minutes, at least 75 minutes, at least 80 minutes, at least 85 minutes, at least 90 minutes, at least 95 minutes, at least 100 minutes, at least 105 minutes, at least 110 minutes, at least 155 minutes, at least 120 minutes, or any value in between any two of the preceding amounts;

(6) cooling the temperature of the second mixture to a temperature below about 60° C., such as, for example, 20° C., 25° C., 30° C., 35° C., 40° C., 45° C., 50° C., 55° C., 60° C., or any value in between any two of the preceding amounts;

(7) preparing a gum base by adding to the second mixture (a) if used, an amount of a kava composition, as described herein, (b) if used, an amount of one or more nootropics, as described herein, (c) if used, an amount of one or more buffers, as described herein, (d) if used, an amount of one or more bulk sweeteners, as described herein, (e) if used, an amount of one or more flavorants, as described herein, and (f) if used, an amount of one or more high intensity sweeteners, as described herein, and mixing until homogenous;

(8) extruding the gum base at a temperature greater than a glass transition temperature of the gum base and below about 150° C.;

(9) cutting the extruded gum base via die cutting, die stamping, laser cutting, or a similar technique to generate one or more chewing gums, as described herein; and

(10) optionally, coating the one or more chewing gums using conventional coating means, such as, for example, spray drying, fluidized bed coating, dip coating, and the like.

Some embodiments provide an oral formulation, as described herein, formulated as a dissolvable oral strip. In some embodiments, a dissolvable oral strip, as described herein, may comprise an amount of a nicotine composition, as described herein, and/or an amount of a kava composition, as described herein, an amount of one or more excipients, and optionally, an amount of one or more nootropics, as described herein.

In certain embodiments, a dissolvable oral strip, as described herein, may comprise an amount of one or more excipients including, but not limited to emulsifiers, fillers, flavorants, high intensity sweeteners, humectants, hydrocolloids, plasticizers, and the like.

In some embodiments, a dissolvable oral strip, as described herein, may comprise an amount of one or more emulsifiers. Emulsifiers, as described herein, include, but are not limited to $C_{10}$-$C_{18}$ fatty acids, diacylglycerides, lecithin, monoglycerides, non-ionic emulsifiers, polyethylene sorbitan esters, polyglycerol esters, propylene glycol, sorbitan monopalmitate, sorbitan monostearate, sorbitan tristearate, and the like. In certain embodiments, a dissolvable oral strip, as described herein, may comprise up to about 2.0% wt. emulsifiers, as described herein, in the dissolvable oral strip, i.e., total dry mass of emulsifiers per dry mass of dissolvable oral strip, such as, for example, 0.01% wt., 0.05% wt., 0.1% wt., 0.15% wt., 0.2% wt., 0.25% wt., 0.3% wt., 0.35% wt., 0.4% wt., 0.45% wt., 0.5% wt., 0.55% wt., 0.6% wt., 0.65% wt., 0.7% wt., 0.75% wt., 0.8% wt., 0.85% wt., 0.9% wt., 0.95% wt., 1.0% wt., 1.05% wt., 1.1% wt., 1.15% wt., 1.2% wt., 1.25% wt., 1.3% wt., 1.35% wt., 1.4% wt., 1.45% wt., 1.5% wt., 1.55% wt., 1.6% wt., 1.65% wt., 1.7% wt., 1.75% wt., 1.8% wt., 1.85% wt., 1.9% wt., 1.95% wt., 2.0% wt., or any value in between any two of the preceding amounts.

In some embodiments, a dissolvable oral strip, as described herein, may comprise an amount of one or more fillers. Fillers, as described herein, include, but are not limited to aluminum oxide, aluminum silicates, calcium carbonate, calcium diphosphate, calcium monophosphate, calcium sulfate, calcium triphosphate, cellulose, clays, magnesium carbonate, magnesium silicates, microcrystalline cellulose, silicates, talc, titanium dioxide, zinc oxide, and the like. In certain embodiments, a dissolvable oral strip, as described herein, may comprise between about 1.0% wt. and about 30% wt. fillers, as described herein, in the dissolvable oral strip, i.e., total dry mass of fillers per dry mass of dissolvable oral strip, such as, for example, 1.0% wt., 2.5% wt., 5.0% wt., 7.5% wt., 10.0% wt., 12.5% wt., 15.0% wt., 17.5% wt., 20.0% wt., 22.5% wt., 25.0% wt., 27.5% wt., 30.0% wt., or any value in between any two of the preceding amounts.

In some embodiments, a dissolvable oral strip, as described herein, may comprise an amount of one or more flavorants. Flavorants, as described herein, include, but are not limited to apple flavoring, apricot flavoring, banana flavoring, berry flavoring, blackberry flavoring, blueberry flavoring, bubble gum flavoring, caramel flavoring, cherry flavoring, chocolate flavoring, cinnamon flavoring, citrus flavoring, coconut flavoring, coffee flavoring, cotton candy flavoring, cranberry flavoring, fruit punch flavoring, grape flavoring, grapefruit flavoring, hickory smoke flavoring, kiwi flavoring, lavender flavoring, lemon flavoring, lime flavoring, mango flavoring, maple flavoring, mint flavoring, orange flavoring, peach flavoring, peppermint flavoring, pineapple flavoring, plum flavoring, pomegranate flavoring, raspberry flavoring, spearmint flavoring, strawberry flavoring, tangerine flavoring, tobacco-imitation flavoring, vanilla flavoring, watermelon flavoring, wintergreen flavoring, and the like. In certain embodiments, a dissolvable oral strip, as described herein, may comprise between about 0.1% wt. and about 20.0% wt, flavorants, as described herein, in the dissolvable oral strip, i.e., total dry mass of flavorants per dry mass of dissolvable oral strip, such as, for example, 0.1% wt., 0.5% wt., 1% wt., 1.5% wt., 2.0% wt., 2.5% wt., 3.0% wt., 3.5% wt., 4.0% wt., 4.5% wt., 5.0% wt., 5.5% wt., 6.0% wt., 6.5% wt., 7.0% wt., 7.5% wt., 8.0% wt., 8.5% wt., 9.0% wt., 9.5% wt., 10.0% wt., 10.5% wt., 12.0% wt., 12.5% wt., 13.0% wt., 13.5% wt., 14.0% wt., 14.5% wt., 15.0% wt., 15.5% wt., 16.0% wt., 16.5% wt., 17.0% wt., 17.5% wt., 18.0% wt., 18.5% wt., 19.0% wt., 19.5% wt., 20.0% wt., any value in between any two of the preceding amounts.

In some embodiments, a dissolvable oral strip, as described herein, may comprise an amount of one or more high intensity sweeteners. High intensity sweeteners, as described herein, include, but are not limited to acesulfame potassium, advantame, alitame, aspartame, dihydrochalcones, glycyrrhizin, monk fruit extract, neotame, saccharin, sodium saccharin, stevia, stevioside, sucralose, thaumatin, and the like. In certain embodiments, a dissolvable oral strip, as described herein, may comprise up to about 2.0% wt. high intensity sweeteners, as described herein, in the dissolvable oral strip, i.e., total dry mass of high intensity sweeteners per dry mass of dissolvable oral strip, such as, for example, 0.01% wt., 0.05% wt., 0.1% wt., 0.15% wt., 0.2% wt., 0.25% wt., 0.3% wt., 0.35% wt., 0.4% wt., 0.45% wt., 0.5% wt., 0.55% wt., 0.6% wt., 0.65% wt., 0.7% wt., 0.75% wt., 0.8% wt., 0.85% wt., 0.9% wt., 0.95% wt., 1.0% wt., 1.05% wt., 1.1% wt., 1.15% wt., 1.2% wt., 1.25% wt., 1.3% wt., 1.35% wt., 1.4% wt., 1.45% wt., 1.5% wt., 1.55% wt., 1.6% wt., 1.65% wt., 1.7% wt., 1.75% wt., 1.8% wt., 1.85% wt., 1.9% wt., 1.95% wt., 2.0% wt., or any value in between any two of the preceding amounts.

In some embodiments, a dissolvable oral strip, as described herein, may comprise an amount of one or more humectants. Humectants, as described herein, include, but are not limited to aliphatic carboxylic acid esters, aliphatic dicarboxylic acid esters, aliphatic polycarboxylic acid esters, arabitol, erythritol, glycerin, glycerol, hydrogenated starch hydrolysates, isomalt, lactitol, maltitol, mannitol, polyols, sorbitol, xylitol, and the like. In certain embodiments, a dissolvable oral strip, as described herein, may comprise between about 20.0% wt. and about 40.0% wt. humectants, as described herein, in the dissolvable oral strip, i.e., total dry mass of humectants per dry mass of dissolvable oral strip, such as, for example, 20.0% wt., 21.0% wt., 22.0% wt., 23.0% wt., 24.0% wt., 25.0% wt., 26.0% wt., 27.0% wt., 28.0% wt., 29.0% wt., 30.0% wt., 31.0% wt., 32.0% wt., 33.0% wt., 34.0% wt., 35.0% wt., 36.0% wt., 37.0% wt., 38.0% wt., 39.0% wt., 40.0% wt., or any value in between any two of the preceding amounts.

In some embodiments, a dissolvable oral strip, as described herein, may comprise an amount of one or more hydrocolloids. Hydrocolloids, as described herein, include, but are not limited to agar gum, alginates, calcium alginate, carrageenan, cellulose ethers, cellulose gum, gellan gum, ghatti gum, guar gum, gum arabic, gums, locust gum, pectins, pullulan, sodium alginate, tara gum, xanthan gum, and the like. In certain embodiments, a dissolvable oral strip, as described herein, may comprise between about 3.0% wt. and about 50.0% wt. hydrocolloids, as described herein, in the dissolvable oral strip, i.e., total dry mass of hydrocolloids per dry mass of dissolvable oral strip, such as, for example, 3.0% wt., 4.0% wt., 5.0% wt., 7.5% wt., 10.0% wt., 12.5% wt., 15.0% wt., 17.5% wt., 20.0% wt., 22.5% wt., 25.0% wt., 27.5% wt., 30.0% wt., 32.5% wt., 35.0% wt., 37.5% wt., 40.0% wt., 42.5% wt., 45.0% wt., 47.5% wt., 50.0% wt., or any value in between any two of the preceding amounts.

In some embodiments, a dissolvable oral strip, as described herein, may comprise an amount of one or more plasticizers. Plasticizers, as described herein, include, but are not limited to arabitol, corn syrups, erythritol, glycerin, hydrogenated starch hydrolysates, isomalt, lactitol, maltitol, mannitol, polyethylene glycol, polyols, propylene glycol, sorbitol, xylitol, and the like. In certain embodiments, a dissolvable oral strip, as described herein, may comprise up to about 20.0% wt. plasticizers, as described herein, in the dissolvable oral strip, i.e., total dry mass of plasticizers per dry mass of dissolvable oral strip, such as, for example, 0.01% wt., 0.5% wt., 1.0% wt., 1.5% wt., 2.0% wt., 2.5% wt., 3.0% wt., 3.5% wt., 4.0% wt., 4.5% wt., 5.0% wt., 5.5% wt., 6.0% wt., 6.5% wt., 7.0% wt., 7.5% wt., 8.0% wt., 8.5% wt., 9.0% wt., 9.5% wt., 10.0% wt., 10.5% wt., 11.0% wt., 11.5% wt., 12.0% wt., 12.5% wt., 13.0% wt., 13.5% wt., 14.0% wt., 14.5% wt., 15.0% wt., 15.5% wt., 16.0% wt., 16.5% wt., 17.0% wt., 17.5% wt., 18.0% wt., 18.5% wt., 19.0% wt., 19.5% wt., 20.0% wt., or any value in between any two of the preceding amounts.

In some embodiments, a dissolvable oral strip, as described herein, may comprise an amount of maltodextrin. In certain embodiments, a dissolvable oral strip, as described herein, may comprise between about 5.0% wt. and about 60.0% wt. maltodextrin in the dissolvable oral strip, i.e., dry mass of maltodextrin per mass of dissolvable oral strip, such as, for example, 5.0% wt., 7.5% wt., 10.0% wt., 12.5% wt., 15.0% wt., 17.5% wt., 20.0% wt., 22.5% wt., 25.0% wt., 27.5% wt., 30.0% wt., 32.5% wt., 35.0% wt., 37.5% wt., 40.0% wt., 42.5% wt., 45.0% wt., 47.5% wt., 50.0% wt., 52.5% wt., 55.0% wt., 57.5% wt., 60.0% wt., or any value in between any two of the preceding amounts.

In some embodiments, a dissolvable oral strip, as described herein, may further comprise a coating. In certain embodiments a coating, as described herein, may provide an oxygen barrier to the dissolvable oral strip, provide a moisture barrier to the dissolvable oral strip, and/or improve the mechanical properties of the dissolvable oral strip. In some embodiments, a coating, as described herein, may comprise one or more compounds including, but not limited to acetylated monoglyceride, beeswax, bentonite, carboxymethyl cellulose, carnauba wax, cellulose acetate, cellulose acetate phthalate, erythritol, ethylcellulose, gelatin, hydrogenated starch hydrolysates, hydroxymethylcellulose, hydroxypropylated starches, methylcellulose, microcrystalline waxes, hydroxypropyl cellulose, hydroxypropyl methylcellulose, hydroxypropyl methylcellulose phthalate, isomalt, kaolin, lactitol, maltitol, mannitol, medium chain triglycerides, methacrylic acid copolymer, methylcellulose, pharmaceutical glaze, polyols, polyvinyl acetate phthalate, shellac, sodium carboxymethylcellulose, sorbitol, starches, sucrose, titanium dioxide, xylitol, waxes, zein, and the like.

In certain embodiments, a dissolvable oral strip, as described herein, may be formulated to comprise a pH between about pH 7.0 and about pH 10.0, such as, for example, pH 7.0, pH 7.1, pH 7.2, pH 7.3, pH 7.4, pH 7.5, pH 7.6, pH 7.7, pH 7.8, pH 7.9, pH 8.0, pH 8.1, pH 8.2, pH 8.3, pH 8.4, pH 8.5, pH 8.6, pH 8.7, pH 8.8, pH 8.9, pH 9.0, pH 9.1, pH 9.2, pH 9.3, pH 9.4, pH 9.5, pH 9.6, pH 9.7, pH 9.8, pH 9.9, pH 10.0, or any value in between any two of the preceding amounts. Without being bound by any particular theory, it is believed that a dissolvable oral strip comprising a pH between about pH 7.0 and about pH 10.0, as described herein, can have: (i) a desirable taste profile, and/or (ii) favorable absorption of a nicotine composition, as described herein, a kava composition, as described herein, and/or one or more nootropics, as described herein, without negatively impacting the oral mucosa of the user.

In certain embodiments, a dissolvable oral strip, as described herein, may comprise a dissolution time. As used herein, the term "dissolution time," refers to the length of time for the dissolvable oral strip to dissolve when provided in a user's oral cavity. In some embodiments, a dissolvable oral strip dissolution time, as described herein, may be at most 5 minutes, such as, for example, at most 5 minutes, at most 4.5 minutes, at most 4 minutes, at most 3.5 minutes, at most 3 minutes, at most 2.5 minutes, at most 2 minutes, at most 1.5 minutes, at most 1 minute, at most 55 seconds, at most 50 seconds, at most 45 seconds, at most 40 seconds, at most 35 seconds, at most 30 seconds, at most 25 seconds, at most 20 seconds, or any value in between any two of the preceding amounts.

Some embodiments provide a method of making a dissolvable oral strip, as described herein. In certain embodiments, a method of making a dissolvable oral strip, as described herein, may comprise the steps of:

(1) preparing a first mixture by adding: (a) an amount of one or more hydrocolloids, as described herein, (b) if used, an amount of one or more fillers, as described herein, (c) if used, an amount of one or more humectants, as described herein, and (d) if used, an amount of maltodextrin, as described herein, to a liquid phase comprising water, an alcohol, or the combination thereof;

(2) heating the first mixture under stirring to a temperature of at least about 50° C., such as, for example, 50° C., 55° C., 60° C., 65° C., 70° C., 75° C., 80° C., 85° C., 90° C., 95° C., 100° C., or any value in between any two of the preceding amounts;

(3) maintaining a temperature of the first mixture under stirring for at least 5 minutes, such as, for example, at least 5 minutes, at least 10 minutes, at least 15 minutes, at least 20 minutes, at least 25 minutes, at least 30 minutes, or any value in between any two of the preceding amounts, wherein the temperature is at least about 50° C., such as, for example, 50° C., 55° C., 60° C., 65° C., 70° C., 75° C., 80° C., 85° C., 90° C., 95° C., 100° C., or any value in between any two of the preceding amounts;

(4) cooling the first mixture under stirring to a temperature between about 35° C. and about 60° C., such as, for example, 35° C., 40° C., 45° C., 50° C., 55° C., 60° C., or any value in between any two of the preceding amounts;

(5) preparing a second mixture by adding to the first mixture: (a) an amount of a nicotine composition, as described herein, (b) if, used an amount of a kava composition, as described herein, (c) if used, an amount of one or more emulsifiers, as described herein, (d) if used, an amount of one or more flavorants, as described herein, (e) if used, an amount of one or more high intensity sweeteners, as described herein, (f) if used, an amount of one or more plasticizers, as described herein, and (g) if used, an amount of one or more nootropics, as described herein;

6) maintaining a temperature of the second mixture under stirring between about 35° C. and about 60° C., such as, for example, 35° C., 40° C., 45° C., 50° C., 55° C., 60° C., or any value in between any two of the preceding amounts, for at least 5 minutes, such as, for example, at least 5 minutes, at least 10 minutes, at least 15 minutes, at least 20 minutes, at least 25 minutes, at least 30 minutes, or any value in between any two of the preceding amounts;

(7) performing a step selected from (7a) and (7b), wherein (7a) comprises: (i) casting the second mixture on a substrate using a casting technique selected from draw down blade casting, gravure printing, slot die casting, tape casting, or a similar technique; (ii) drying the substrate at a temperature between about 20° C. and about 50° C., such as, for example, 25° C., 30° C., 35° C., 40° C., 45° C., 50° C., or any value in between any two of the preceding amounts, for a time between about 15 minutes and about 5 days to generate a dry film; and (iii) cutting the dry film via die cutting, die stamping, laser cutting, or a similar technique to generate one or more oral dissolvable strips, as described herein; and wherein (7b) comprises: (i) extruding the second mixture at a temperature greater than a glass transition temperature of the second mixture and below about 150° C. to generate a dry film; and (ii) cutting the dry film via die cutting, die stamping, laser cutting, or a similar technique to generate one or more oral dissolvable strips, as described herein; and (8) optionally, coating the oral dissolvable strips using conventional coating means, such as, for example, spray drying, fluidized bed coating, dip coating, and the like.

Some embodiments provide an oral formulation, as described herein, formulated as a pouch. In some embodiments, a pouch, as described herein, may comprise an amount of a nicotine composition, as described herein, and/or an amount of a kava composition, as described herein, an amount of one or more excipients, and optionally, an amount of one or more nootropics, as described herein.

As used herein, the term "pouch" refers a container formed by a web or fabric comprising one or more fibrous materials enclosing a cavity, configured to contain, within the cavity, a nicotine composition, as described herein, a kava composition, as described herein, one or more excipients, as described herein, and optionally, an amount of one or more nootropics, as described herein. A pouch, as described herein, is configured to be used within the oral cavity of a user, and may be used by, for example, by placing the pouch (i) between a user's gums and buccal tissue, or (ii) under a user's tongue. The web or fabric of a pouch, as described herein, may comprise a woven structure or a non-woven structure, and is configured to be water-/saliva-permeable, thus permitting water and/or saliva from the oral cavity of a user to penetrate through the web or fabric and contact the components contained within the cavity of the pouch, thereby facilitating release of the nicotine composition, as described herein, and/or the kava composition, as described herein, from the cavity of the pouch to the user's oral cavity tissue for absorption. Suitable fibrous materials comprising the web or fabric of a pouch, as described herein, comprise materials that are both non-toxic and insoluble in water and/or saliva, such as, for example, cellulose, cotton, fleece, natural polymers, paper, plant fibers, synthetic polymers, and the like. Suitable methods for manufacturing a pouch, as described herein, are not particularly limited, and may comprise, for example, sealing the pouch by bonding two corresponding pieces of web or fabric to each other along their edges to form a cavity, as described herein.

In certain embodiments, a pouch, as described herein, may comprise an amount of one or more excipients including, but not limited to bulk sweeteners, enhancers, fillers, flavorants, high intensity sweeteners, humectants, pH controlling agents, release modifiers, sugar alcohols, and the like.

In some embodiments, a pouch, as described herein, may comprise an amount of one or more bulk sweeteners. Bulk sweeteners, as described herein, include, but are not limited to corn syrup solids, dextrins, dextrose, disaccharides, D-tagatose, erythritol, fructose, galactose, hydrogenated starch hydrolysates, isomalt, lactitol, levulose, maltitol, maltose, mannitol, monosaccharaides, polyols, polysaccharides, sorbitol, sucrose, trehalose, xylitol, and the like. In certain embodiments, a pouch, as described herein, may comprise up to about 95.0% wt. bulk sweeteners, as described herein, in the pouch, i.e., total mass of bulk sweeteners per mass of pouch contents, such as, for example, 0.5% wt., 1.0% wt., 2.5% wt., 5.0% wt., 7.5% wt., 10.0% wt., 12.5% wt., 15.0% wt., 17.5% wt., 20.0% wt., 22.5% wt., 25.0% wt., 27.5% wt., 30.0% wt., 32.5% wt., 35.0% wt., 37.5% wt., 40.0% wt., 42.5% wt., 45.0% wt., 47.5% wt., 50.0% wt., 52.5% wt., 55.0% wt., 57.5% wt., 60.0% wt., 62.5% wt., 65.0% wt., 67.5% wt., 70.0% wt., 72.5% wt., 75.0% wt., 77.5% wt., 80.0% wt., 82.5% wt., 85.0% wt., 87.5% wt., 90.0% wt., 92.5% wt., 95.0% wt., or any value in between any two of the preceding amounts.

In some embodiments, a pouch, as described herein, may comprise an amount of one or more enhancers. Enhancers, as described herein, include, but are not limited to 2-(2-ethoxyethoxy) ethanol, 5-methoxysalicylic acid, α-tocopherol succinate, acetylated amino acids, acetyl salicylate, acyl esters of proline, alanine, alkyl esters of pyrrolidonecarboxylic acid, alkylglycosides, alkali-/alkaline-metal alkyl sulphates, alkali-/alkaline-metal hyaluronates, alkali-/alkaline-metal citrates, alkali-/alkaline-metal lactates, alkali-/alkaline-metal malates, alkali-/alkaline-metal salts, alkyl saccharides, amino acids, amino acid salts, aspartic acid, benzalkonium chloride, bile acids, bile acid conjugates, bile acid derivatives, bile acid salts, capric acid glycerides, caproic acid, caprylic acid glycerides, caprylocaproyl glycerides, cephalin, cetyl alcohol, cetyltrimethylammonium bromide, cetylpyridinium chloride, chenodeoxycholate, chitosan, citric acid, deoxycholate, dextran sulphate, didecanoyl-L-α-phosphatidylcholine, diethyl maleate, dioctyl sulfosuccinate, docosahexaenoic acid, ethylenediaminetetraacetic acid, ethylene glycol tetraacetic acid, fatty acids, fusidic acid, fusidic acid derivatives, glutamic acid, glycerin, glycerol monocaprylate, glyceryl diacetate, glyceryl monolaurate, glyceryl monooleate, glyceryl fatty acids, glycine, glycodeoxycholic acid, glycolic acid, hyaluronic acid, hydrogenated castor oil, hydroxyamino acids, hydroxyproline, isopropylideneglycerol, Labrafil®, lactic acid, lanolin alcohol, lauric acid, laurocapram, lecithin, linoleic acid, lysine, lysolecithin, lysophosphatidylcholines, malic acid, menthol, methoxysalicylates, monolaurates, monooleates, monoolein, N-lauryl-β-D-maltopyranoside, N-acetyl alanine, N-acetyl glutamic acid, N-acetyl glycine, N-acetyl hydroxyproline, N-acetyl lysine, N-acetyl phenylalanine, N-acetyl proline, N-acetyl serine, N-alkyl pyrrollidones, nonionic surfactants, nonylphenol ethoxylates, octylphenoxypolyethoxyethanol, oleic acid ethoxylates, olive oil, phenylalanine, phosphatidylcholine, phosphatidylethanolamine, phosphatidylserine, polidocanol alkyl ethers, poloxamers, polyethylene glycol, polyethylene glycol dodecyl ether, polyethylene glycol ethers of lauryl alcohol, polyethylene glycol esters, polyethylene glycol esters of lauric acid, polyethylene glycol esters of oleic acid, polyethylene glycol esters of stearic acid, polyglycerol polyricinoleate, poly-L-arginine, polylysine, polyoxyethylene alkyl ethers, polyoxyethylene ethers of cetyl alcohol, polyoxyethylene ethers of lauryl alcohol, polyoxyethylene ethers of oleyl alcohol, polyoxyethylene ethers of stearyl alcohol, polysorbates, polysorbate 20, polysorbate 80, polyvinyl alcohol, polyvinylpyrrolidone, proline, propylene glycol, propylene glycol dicaprylate, pyrrolidonecarboxylic acids, saccharide alkyl esters, salicylamide, saponins, serine, sodium caprate, sodium cholate, sodium citrate, sodium ethylenediaminetetraacetic acid, sodium glycocholate, sodium laurate, sodium lauryl phosphate, sodium lauryl sulfate, sodium myristyl sulphate, sodium nitroprusside, sodium oleyl phosphate, sodium salicylate, sodium taurdihydrofusidate, sodium taurocholate, sodium taurocholate choline salicylate, sorbitan esters, sorbitan monooleate, sucrose esters, sulfoxides, taurocholic acid, taurodeoxycholic acid, triolein, triolein esters, urea, and the like. In certain embodiments, a pouch, as described herein, may comprise up to about 15.0% wt. enhancers, as described herein, in the pouch, i.e., total mass of enhancers per mass of pouch contents, such as, for example, 0.1% wt., 0.5% wt., 1.0% wt., 1.5% wt., 2.0% wt., 2.5% wt., 3.0% wt., 3.5% wt., 4.0% wt., 4.5% wt., 5.0% wt., 5.5% wt., 6.0% wt., 6.5% wt., 7.0% wt., 7.5% wt., 8.0% wt., 8.5% wt., 9.0% wt., 9.5% wt., 10.0% wt., 10.5% wt., 11.0% wt., 11.5% wt., 12.0% wt., 12.5% wt., 13.0% wt., 13.5% wt., 14.0% wt., 14.5% wt., 15.0% wt., or any value in between any two of the preceding amounts.

In some embodiments, a pouch, as described herein, may comprise an amount of one or more fillers. Fillers, as described herein, include, but are not limited to acetylated monoglycerides, calcium carbonate, calcium sulfate, cellulose, citric acid, clays, corn starch, dextrates, dextrins, dextrose, dibasic calcium phosphate, fructose, glycerol monostearate, glyceryl palmitostearate, gum arabic, hydroxypropyl cellulose, hypromellose, kaolin, lactose, magnesium stearate, maltitol, maltodextrin, mannitol, microcrystalline cellulose, polysorbate 80, potassium carbonate, potassium silicate, potassium sorbate, potassium stearate, pregelatinized starches, propylene glycol monostearate, sodium alginate, sodium benzoate, sodium bicarbonate, sodium carbonate, sodium lauryl sulfate, sodium sorbitol, starches, stearyl fumarate, sucrose, talc, titanium dioxide, waxes, xanthan gum, and the like. In certain embodiments, a pouch, as described herein, may comprise up to about 95.0% wt. fillers, as described herein, in the pouch, i.e., total mass of fillers per mass of pouch contents, such as, for example, 0.5% wt., 1.0% wt., 2.5% wt., 5.0% wt., 7.5% wt., 10.0% wt., 12.5% wt., 15.0% wt., 17.5% wt., 20.0% wt., 22.5% wt., 25.0% wt., 27.5% wt., 30.0% wt., 32.5% wt., 35.0% wt., 37.5% wt., 40.0% wt., 42.5% wt., 45.0% wt., 47.5% wt., 50.0% wt., 52.5% wt., 55.0% wt., 57.5% wt., 60.0% wt., 62.5% wt., 65.0% wt., 67.5% wt., 70.0% wt., 72.5% wt., 75.0% wt., 77.5% wt., 80.0% wt., 82.5% wt., 85.0% wt., 87.5% wt., 90.0% wt., 92.5% wt., 95.0% wt., or any value in between any two of the preceding amounts.

In some embodiments, a pouch, as described herein, may comprise an amount of one or more flavorants. Flavorants, as described herein, include, but are not limited to apple flavoring, apricot flavoring, banana flavoring, berry flavoring, blackberry flavoring, blueberry flavoring, bubble gum flavoring, caramel flavoring, cherry flavoring, chocolate flavoring, cinnamon flavoring, citrus flavoring, coconut flavoring, coffee flavoring, cotton candy flavoring, cranberry flavoring, fruit punch flavoring, grape flavoring, grapefruit flavoring, hickory smoke flavoring, kiwi flavoring, lavender flavoring, lemon flavoring, lime flavoring, mango flavoring, maple flavoring, mint flavoring, orange flavoring, peach flavoring, peppermint flavoring, pineapple flavoring, plum flavoring, pomegranate flavoring, raspberry flavoring, spearmint flavoring, strawberry flavoring, tangerine flavoring, tobacco-imitation flavoring, vanilla flavoring, watermelon flavoring, wintergreen flavoring, and the like. In certain embodiments, a pouch, as described herein, may comprise between about 0.1% wt. and about 20.0% wt, flavorants, as described herein, in the pouch, i.e., total mass of flavorants per mass of pouch contents, such as, for example, 0.1% wt., 0.5% wt., 1.0% wt., 1.5% wt., 2.0% wt., 2.5% wt., 3.0% wt., 3.5% wt., 4.0% wt., 4.5% wt., 5.0% wt., 5.5% wt., 6.0% wt., 6.5% wt., 7.0% wt., 7.5% wt., 8.0% wt., 8.5% wt., 9.0% wt., 9.5% wt., 10.0% wt., 10.5% wt., 11.0% wt., 11.5% wt., 12.0% wt., 12.5% wt., 13.0% wt., 13.5% wt., 14.0% wt., 14.5% wt., 15.0% wt., 15.5% wt., 16.0% wt., 16.5% wt., 17.0% wt., 17.5% wt., 18.0% wt., 18.5% wt., 19.0% wt., 19.5% wt., 20.0% wt., or any value in between any two of the preceding amounts.

In some embodiments, a pouch, as described herein, may comprise an amount of one or more high intensity sweeteners. High intensity sweeteners, as described herein, include, but are not limited to acesulfame potassium, advantame, alitame, aspartame, dihydrochalcones, glycyrrhizin, monk fruit extract, neotame, saccharin, sodium saccharin, stevia, stevioside, sucralose, thaumatin, and the like. In certain embodiments, a pouch, as described herein, may comprise up to about 8.0% wt. high intensity sweeteners, as described herein, in the pouch, i.e., total mass of high intensity sweeteners per mass of pouch contents, such as, for example, 0.1% wt., 0.25% wt., 0.5% wt., 0.75% wt., 1.0% wt., 1.25% wt., 1.5% wt., 1.75% wt., 2.0% wt., 2.25% wt., 2.5% wt., 2.75% wt., 3.0% wt., 3.25% wt., 3.5% wt., 3.75% wt., 4.0% wt., 4.25% wt., 4.5% wt., 4.75% wt., 5.0% wt., 5.25% wt., 5.5% wt., 5.75% wt., 6.0% wt., 6.25% wt., 6.5% wt., 6.75% wt., 7.0% wt., 7.25% wt., 7.5% wt., 7.75% wt., 8.0% wt., or any value in between any two of the preceding amounts.

In some embodiments, a pouch, as described herein, may comprise an amount of one or more humectants. Humectants, as described herein, include, but are not limited to alginate, aliphatic carboxylic acid esters, aliphatic dicarboxylic acid esters, aliphatic polycarboxylic acid esters, arabitol, cellulose, erythritol, glycerin, glycerol, hydrogenated starch hydrolysates, isomalt, lactitol, maltitol, mannitol, microcrystalline cellulose, pectins, polyols, sorbitol, xanthan gum, xylitol, and the like. In certain embodiments, a pouch, as described herein, may comprise between about 20.0% wt. and about 40.0% wt. humectants, as described herein, in the pouch, i.e., total mass of humectants per mass of pouch contents, such as, for example, 20.0% wt., 21.0% wt., 22.0% wt., 23.0% wt., 24.0% wt., 25.0% wt., 26.0% wt., 27.0% wt., 28.0% wt., 29.0% wt., 30.0% wt., 31.0% wt., 32.0% wt., 33.0% wt., 34.0% wt., 35.0% wt., 36.0% wt., 37.0% wt., 38.0% wt., 39.0% wt., 40.0% wt., or any value in between any two of the preceding amounts.

In some embodiments, a pouch, as described herein, may comprise an amount of one or more pH controlling agents. pH controlling agents, as described herein, include, but are not limited to acetic acid, adipic acid, ascorbic acid, calcium diphosphate, calcium carbonate, calcium orthophosphate, carbonic acid, citric acid, fumaric acid, gluconic acid, glucono-8-lactone, lactic acid, magnesium carbonate, magnesium oxide, maleic acid, malic acid, pentapotassium triphosphate, pentasodium triphosphate, phosphoric acid, potassium carbonate, potassium diphosphate, potassium orthophosphate, potassium polyphosphate, propionic acid, sodium bicarbonate, sodium carbonate, sodium diphosphate, sodium orthophosphate, sodium polyphosphate, succinic acid, tartaric acid, and any combination thereof. In certain embodiments, a pouch, as described herein, may comprise up to about 10.0% wt. pH controlling agents, as described herein, in the pouch, i.e., total mass of pH controlling agents per mass of pouch contents, such as, for example, 0.1% wt., 0.25% wt., 0.5% wt., 0.75% wt., 1.0% wt., 1.25% wt., 1.5% wt., 1.75% wt., 2.0% wt., 2.25% wt., 2.5% wt., 2.75% wt., 3.0% wt., 3.25% wt., 3.5% wt., 3.75% wt., 4.0% wt., 4.25% wt., 4.5% wt., 4.75% wt., 5.0% wt., 5.25% wt., 5.5% wt., 5.75% wt., 6.0% wt., 6.25% wt., 6.5% wt., 6.75% wt., 7.0% wt., 7.25% wt., 7.5% wt., 7.75% wt., 8.0% wt., 8.25% wt., 8.5% wt., 8.75% wt., 9.0% wt., 9.25% wt., 9.5% wt., 9.75% wt., 10.0% wt., or any value in between any two of the preceding amounts.

In some embodiments, a pouch, as described herein, may comprise an amount of one or more release modifiers. Release modifiers, as described herein, include, but are not limited to alkali-/alkaline-metal stearates, calcium carbonate, calcium stearate, fats, hydrogenated oils, hydroxyethyl cellulose, hydroxymethyl cellulose, hydroxypropyl cellulose, hydroxypropyl calcium stearate, methylcellulose, magnesium stearate, methylcellulose, partially hydrogenated oils, polyethylene glycols, polyethylene oxides, polyhydroxyethylmethacrylate, polymethylmethacrylate, polyoxyethylene monostearates, polyvinyl alcohol, polyvinylpyrrolidone, polyvinylpyrrolidone/vinyl acetate copolymers, silicates, silicon dioxide, talc, and the like. In certain embodiments, a pouch, as described herein, may comprise between about 0.5% wt. and about 20.0% wt. release modifiers, as described herein, in the pouch, i.e., total mass of release modifiers per mass of pouch contents, such as, for example, 0.5% wt., 1.0% wt., 1.5% wt., 2.0% wt., 2.5% wt., 3.0% wt., 3.5% wt., 4.0% wt., 4.5% wt., 5.0% wt., 5.5% wt., 6.0% wt., 6.5% wt., 7.0% wt., 7.5% wt., 8.0% wt., 8.5% wt., 9.0% wt., 9.5% wt., 10.0% wt., 10.5% wt., 11.0% wt., 11.5% wt., 12.0% wt., 12.5% wt., 13.0% wt., 13.5% wt., 14.0% wt., 14.5% wt., 15.0% wt., 15.5% wt., 16.0% wt., 16.5% wt., 17.0% wt., 17.5% wt., 18.0% wt., 18.5% wt., 19.0% wt., 19.5% wt., 20.0% wt., or any value in between any two of the preceding amounts.

In some embodiments, a pouch, as described herein, may comprise an amount of one or more sugar alcohols. Sugar alcohols, as described herein, include, but are not limited to arabitol, erythritol, glycerol, hydrogenated starch hydrolysates, isomalt, lactitol, maltitol, mannitol, polyols, sorbitol, xylitol, and the like. In certain embodiments, a pouch, as described herein, may comprise up to about 95.0% wt. sugar alcohols, as described herein, in the pouch, i.e., total mass of sugar alcohols per mass of pouch contents, such as, for example, 0.5% wt., 1.0% wt., 2.5% wt., 5.0% wt., 7.5% wt., 10.0% wt., 12.5% wt., 15.0% wt., 17.5% wt., 20.0% wt., 22.5% wt., 25.0% wt., 27.5% wt., 30.0% wt., 32.5% wt., 35.0% wt., 37.5% wt., 40.0% wt., 42.5% wt., 45.0% wt., 47.5% wt., 50.0% wt., 52.5% wt., 55.0% wt., 57.5% wt., 60.0% wt., 62.5% wt., 65.0% wt., 67.5% wt., 70.0% wt., 72.5% wt., 75.0% wt., 77.5% wt., 80.0% wt., 82.5% wt., 85.0% wt., 87.5% wt., 90.0% wt., 92.5% wt., 95.0% wt., or any value in between any two of the preceding amounts.

In certain embodiments, a pouch, as described herein, may be formulated to comprise a pH between about pH 7.0 and about pH 10.0, such as, for example, pH 7.0, pH 7.1, pH 7.2, pH 7.3, pH 7.4, pH 7.5, pH 7.6, pH 7.7, pH 7.8, pH 7.9, pH 8.0, pH 8.1, pH 8.2, pH 8.3, pH 8.4, pH 8.5, pH 8.6, pH 8.7, pH 8.8, pH 8.9, pH 9.0, pH 9.1, pH 9.2, pH 9.3, pH 9.4, pH 9.5, pH 9.6, pH 9.7, pH 9.8, pH 9.9, pH 10.0, or any value in between any two of the preceding amounts. Without being bound by any particular theory, it is believed that a pouch comprising a pH between about pH 7.0 and about pH 10.0, as described herein, can have: (i) a desirable taste profile, and/or (ii) favorable absorption of a nicotine composition, as described herein, a kava composition, as described herein, and/or one or more nootropics, as described herein, without negatively impacting the oral mucosa of the user.

In some embodiments, a pouch, as described herein, may be formulated to comprise a duration of use. As used herein, the term "duration of use," refers to the length of time for the pouch to release at least 80% of the nicotine composition contained within the chewable tablet, as described herein, and/or at least 80% of the kava composition contained within the chewable tablet, as described herein, when the pouch is provided within the oral cavity of the user. In certain embodiments, a duration of use, as described herein, may be at least 5 minutes, such as, for example, at least 5 minutes, at least 10 minutes, at least 15 minutes, at least 20 minutes, at least 25 minutes, at least 30 minutes, at least 35 minutes, at least 40 minutes, at least 45 minutes, at least 50 minutes, at least 55 minutes, at least 60 minutes, or any value in between any two of the preceding amounts.

Some embodiments provide a method of making a pouch, as described herein. In certain embodiments, a method of making a pouch, as described herein, may comprise the steps of:

(1) preparing a first mixture by mixing: (a) an amount of a nicotine composition, as described herein, (b) if used, an amount of a kava composition, as described herein, (c) if used, an amount of one or more enhancers, as described herein, (d) if used, an amount of one or more fillers, as described herein, (e) if used, an amount of one or more flavorants, as described herein, (f) if used, an amount of one or more humectants, as described herein, (g) if used, an amount of one or more pH controlling agents, as described herein, (h) if used, an amount of one or more release modifiers, as described herein, (i) if used, an amount of one or more sugar alcohols, as described herein, and (j) if used, an amount of one or more nootropics, as described herein;

(2) optionally, sieving the first mixture and drying the first mixture at room temperature for at least one hour, such as, for example, at least one hour, at least two hours, at least four hours, at least six hours, at least eight hours, at least ten hours, at least twelve hours, at least fourteen hours, at least sixteen hours, at least eighteen hours, at least twenty hours, at least twenty-two hours, at least twenty-four hours, or any value in between any two of the preceding amounts;

(3) preparing a second mixture by adding to the first mixture: (a) if used, an amount of one or more bulk sweeteners, as described herein, and (b) if used, an amount of one or more high intensity sweeteners, as described herein;

(4) preparing an empty pouch with one non-sealed end by: (i) providing a web or fabric, as described herein, and (ii) sealing a first end of the web or fabric thereby creating an internal cavity;

(5) adding an amount of the second mixture to the internal cavity, wherein the amount of the second is selected from 150 mg, 175 mg, 200 mg, 225 mg, 250 mg, 275 mg, 300 mg, 325 mg, 350 mg, 375 mg, 400 mg, 425 mg, 450 mg, 475 mg, 500 mg, 525 mg, 550 mg, 575 mg, 600 mg, 625 mg, 650 mg, 675 mg, 700 mg, 725 mg, 750 mg, 775 mg, 800 mg, 825 mg, 850 mg, 875 mg, 900 mg, or any value in between any two of the preceding amounts; and (6) sealing a second end of the web or fabric thereby creating a cavity, wherein the second mixture is contained within the cavity.

The compositions disclosed herein may be formulated to comprise a compound in a neutral or salt form. For purposes of this disclosure, "salts" may include, but are not limited to salts derived from inorganic acids like hydrochloric, hydrobromic, nitric, carbonic, monohydrogencarbonic, phosphoric, monohydrogenphosphoric, dihydrogenphosphoric, sulfuric, monohydrogensulfuric, hydriodic, or phosphorous acids, and the like, as well as the salts derived from relatively nontoxic organic acids like acetic acid, propionic acid, isobutyric acid, maleic acid, malonic acid, benzoic acid, succinic acid, suberic acid, fumaric acid, lactic acid, mandelic acid, phthalic acid, benzenesulfonic acid, p-tolylsulfonic acid, citric acid, tartaric acid, methanesulfonic acid, and the like. Also included are salts of amino acids such as arginate and the like, and salts of organic acids like glucuronic or galacturonic acids, and the like. (see, for example, Berge et al., J. Pharm. Sci. 1977; 66:1-19, which is hereby incorporated by reference in its entirety). Further included are salts any suitable elemental cation, such as potassium, calcium, and the like, any suitable elemental anion, such as chlorine, bromine, and the like, as well as any pharmaceutically acceptable salt. Depending on the stoichiometric proportions between the charged group(s) in the compound and the counter-ion in the salt, salts disclosed herein can be either mono-addition salts or poly-addition salts. As used herein, the term "mono-addition salt," refers to a salt in which the stoichiometric ratio between the counter-ion and charged form of the compound is 1:1, such that the addition salt includes one molar equivalent of the counter-ion per one molar equivalent of the compound. As used herein, the term "poly-addition salt" refers to a salt in which the stoichiometric ratio between the counter-ion and the charged form of the compound is greater than 1:1 and is, for example, 2:1, 3:1, 4:1 and so on, such that the addition salt includes two or more molar equivalents of the counter-ion per one molar equivalent of the compound.

As used herein, the term "excipient" refers to any compound that is part of a formulation that is not an active ingredient, i.e., one that has no relevant biological activity, and which is added to the formulation to provide specific characteristics to the dosage form, including by way of example, providing protection to the active ingredient from chemical degradation, facilitating release of a tablet or caplet from equipment in which it is formed, and so forth.

As provided herein, the disclosure of a "ratio" of compounds and compositions corresponds to a ratio provided in terms of mass of the components present in the ratio.

When used in this disclosure, the phrase "consisting essentially of" is meant including any elements listed after the phrase and limited to other elements that do not interfere with or contribute to the activity or action specified in the disclosure for the listed elements. Thus, the phrase "consisting essentially of" indicates that the listed elements are required or mandatory, but that other elements are optional and can or cannot be present depending upon whether or not they affect the activity or action of the listed elements. For example, the use of a composition "consisting essentially of a composition" for the treatment of a particular disease or disorder, or the maintenance of a healthy condition, would exclude other ingredients that would materially alter the intended outcome of the composition.

As used herein, a composition that "substantially" comprises a compound means that the composition contains more than about 80% by weight, more preferably more than about 90% by weight, even more preferably more than about 95% by weight, and most preferably more than about 98% by weight of the compound.

To provide a more concise description, some of the quantitative expressions given herein are not qualified with the term "about." It is understood that whether the term "about" is used explicitly or not, every quantity given herein is meant to refer to the actual given value, and it is also meant to refer to the approximation to such given value that would reasonably be inferred based on the ordinary skill in the art, including approximations due to the experimental and/or measurement conditions for such given value.

EXAMPLES

Example 1

Pouches comprising an amount of a nicotine composition and a kava composition were prepared in accordance with the methods disclosed herein.

A first mixture was prepared by mixing an amount of a nicotine composition, as described herein, an amount of a filler, as described herein, an amount of a kava composition, as described herein, and an amount of a flavorant, as described herein.

A second mixture was prepared by adding to the first mixture an amount of a high intensity sweetener, as described herein.

An empty pouch was prepared by providing a web or fabric comprising plant fibers, and sealing a first end of the web or fabric thereby creating an internal cavity.

The empty pouch was filled with between about 400 mg and about 500 mg of the second mixture.

A second end of the web or fabric was sealed to create a cavity, in which the second mixture was contained, to produce a pouch.

According to the foregoing methods, the permissible amounts of pouch contents were as follows: (i) between about 3 mg and about 12 mg of a nicotine composition comprising at least one selected from nicotine, nicotine acetate, nicotine benzoate, nicotine bitartrate, nicotine bitartrate dihydrate, nicotine citrate, nicotine dihydrochloride, nicotine formate, nicotine hydrochloride, nicotine lactate, nicotine laurate, nicotine levulinate, nicotine malate, nicotine polacrilex, nicotine pyruvate, nicotine salicylate, nicotine sorbate, nicotine succinate, nicotine sulphate, nicotine tartrate, nicotine zinc chloride monohydrate, and any combination thereof; (ii) between about 5 mg and about 20 mg of a high intensity sweetener, as described herein; (iii) between about 100 mg and about 200 mg of a filler, as described herein; (iv) a kava composition comprising between about 200 mg and about 300 mg of total kavalactones; and (v) between about 25 mg and about 75 mg of a flavorant.

Example 2

Pouches comprising an amount of a nicotine composition and a kava composition were prepared in accordance with the methods disclosed herein.

A first mixture was prepared by mixing an amount of nicotine bitartrate dihydrate, an amount of maltodextrin, an amount of a kava composition formulated as a paste, and an amount of peppermint flavoring.

A second mixture was prepared by adding to the first mixture an amount of stevia.

An empty pouch was prepared by providing a web or fabric comprising plant fiber, and sealing a first end of the web or fabric thereby creating an internal cavity.

The empty pouch was filled with between about 460 mg and about 480 mg of the second mixture.

A second end of the web or fabric was sealed to create a cavity, in which the second mixture was contained, to produce a pouch.

According to the foregoing methods, the permissible amounts of pouch contents were as follows: (i) about 9 mg of nicotine bitartrate dihydrate; (ii) about 10 mg of stevia; (iii) about 150 mg of maltodextrin; (iv) between about 250 mg and about 260 mg of total kavalactones, and (v) about 50 mg of peppermint flavoring.

The present disclosure is not to be limited in terms of the particular embodiments described in this application, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled. The terminology used herein is for the purpose of describing particular embodiments only and is not intended to be limiting unless otherwise set forth herein.

Example 3

A cohort of adults that identified as daily users of commercially-available nicotine salt pouches were provided pouches that were made in accordance with Example 2. Both pouches contained comparable amounts of nicotine.

During the study, participants were surveyed for their preferences between the pouches of Example 2 and the commercially-available nicotine salt pouches. Of the participating adults, 90% stated a strong preference for the pouches of Example 2 compared to the commercially-available nicotine salt pouches. A significant portion of participants reported that the pouches of Example 2 prolonged the effects of nicotine compared to the commercially-available nicotine salt pouches. In addition, several participants found that the pouches of Example 2 had a more desirable taste profile than the commercially-available nicotine salt pouches and induced a pleasurable numbness in the oral cavity. Surprisingly, a majority of participants reported that their nicotine consumption was reduced when using the pouches of Example 2 compared to their normal nicotine consumption level when using the commercially-available nicotine salt pouches. Without being bound by any particular theory, the unexpected results relating to reduced nicotine consumption likely arise as a consequence of the inclusion of a kava composition in the pouches of Example 2, an effect that may be further compounded by the pouches of Example 2 prolonging the effects of nicotine, as discussed above.

The present disclosure is not to be limited in terms of the particular embodiments described in this application, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled. The terminology used herein is for the purpose of describing particular embodiments only and is not intended to be limiting unless otherwise set forth herein.

The invention claimed is:

1. An oral formulation comprising:

(i) an amount of a nicotine composition;

wherein the nicotine composition comprises at least one compound selected from the group consisting of nicotine, nicotine acetate, nicotine benzoate, nicotine bitartrate, nicotine bitartrate dihydrate, nicotine citrate, nicotine dihydrochloride, nicotine formate, nicotine hydrochloride, nicotine lactate, nicotine laurate, nicotine levulinate, nicotine malate, nicotine polacrilex, nicotine pyruvate, nicotine salicylate, nicotine sorbate, nicotine succinate, nicotine sulphate, nicotine tartrate, and nicotine zinc chloride monohydrate; and (ii) an amount of a kava composition;

wherein the kava composition comprises between about 225 mg and about 900 mg of kavalactones; and wherein the kavalactones comprise an amount of kavain, an amount of dihydrokavain, and optionally, an amount of methysticin, an amount of dihydromethysticin, an amount yangonin, and an amount of desmethoxyyangonin.

2. The oral formulation of claim 1, wherein the nicotine composition comprises nicotine bitartrate dihydrate.

3. The oral formulation of claim 2, wherein the nicotine composition comprises between about 0.1 mg and about 20 mg of nicotine bitartrate dihydrate.

4. The oral formulation of claim 3, wherein the nicotine composition comprises between about 3 mg and about 10 mg of nicotine bitartrate dihydrate.

5. The oral formulation of claim 4, wherein the nicotine composition comprises between about 8 mg and about 10 mg of nicotine bitartrate dihydrate.

6. The oral formulation of claim 1, wherein the kava composition is formulated as a paste.

7. The oral formulation of claim 6, wherein the paste comprises between about 68% wt. and about 90% wt. kavalactones.

8. The oral formulation of claim 1, wherein the kava composition comprises between about 225 mg and about 600 mg of kavalactones.

9. The oral formulation of claim 8, wherein the oral formulation is formulated as a chewable tablet, a lozenge, a chewing gum, a dissolvable oral strip, or a pouch.

10. The oral formulation of claim 9, wherein the oral formulation is formulated as a pouch.

11. The oral formulation of claim 8, wherein kava composition is formulated as a paste.

12. The oral formulation of claim 11, wherein the paste comprises between about 68% wt. and about 90% wt. kavalactones.

13. The oral formulation of claim 12, wherein the oral formulation is formulated as a pouch.

14. An oral pouch comprising:

(i) between about 3 mg and about 20 mg of at least one compound selected from the group consisting of nicotine, nicotine acetate, nicotine benzoate, nicotine bitartrate, nicotine bitartrate dihydrate, nicotine citrate, nicotine dihydrochloride, nicotine formate, nicotine hydrochloride, nicotine lactate, nicotine laurate, nicotine levulinate, nicotine malate, nicotine polacrilex, nicotine pyruvate, nicotine salicylate, nicotine sorbate, nicotine succinate, nicotine sulphate, nicotine tartrate, and nicotine zinc chloride monohydrate;

(ii) between about 5 mg and about 20 mg of a high intensity sweetener;

(iii) between about 100 mg and about 200 mg of a filler;

(iv) between about 25 mg and about 75 mg of a flavorant; and (v) between about 200 mg and about 300 mg of a paste;

wherein the paste comprises between about 68% wt. and about 90% wt. kavalactones; and wherein the kavalactones comprise an amount of kavain, an amount of dihydrokavain, and optionally, an amount of methysticin, an amount of dihydromethysticin, an amount yangonin, and an amount of desmethoxyyangonin.

15. The oral pouch of claim 14, wherein the oral pouch comprises:

(i) between about 3 mg and about 20 mg of the at least one compound selected from the group consisting of nicotine, nicotine acetate, nicotine benzoate, nicotine bitartrate, nicotine bitartrate dihydrate, nicotine citrate, nicotine dihydrochloride, nicotine formate, nicotine hydrochloride, nicotine lactate, nicotine laurate, nicotine levulinate, nicotine malate, nicotine polacrilex, nicotine pyruvate, nicotine salicylate, nicotine sorbate, nicotine succinate, nicotine sulphate, nicotine tartrate, and nicotine zinc chloride monohydrate;

(ii) between about 5 mg and about 20 mg of the high intensity sweetener;

(iii) between about 100 mg and about 200 mg of the filler;

(iv) between about 25 mg and about 75 mg of the flavorant; and (v) between about 200 mg and about 300 mg of the paste;

wherein the paste comprises between about 68% wt. and about 90% wt. kavalactones; and wherein the kavalactones comprise an amount of kavain, an amount of dihydrokavain, an amount of methysticin, an amount of dihydromethysticin, an amount yangonin, and an amount of desmethoxyyangonin.

16. The oral pouch of claim 15, wherein the oral pouch is formulated to comprise a pH of between about pH 7.0 and about pH 10.0.

17. The oral pouch of claim 15, wherein:

(i) the at least one compound comprises nicotine bitartrate dihydrate;

(ii) the high intensity sweetener comprises stevia; and (iii) the filler comprises maltodextrin.

* * * * *